US011351593B2

(12) United States Patent
Sacks et al.

(10) Patent No.: US 11,351,593 B2
(45) Date of Patent: Jun. 7, 2022

(54) EXPANDED METAL FORMED USING ROTARY BLADES AND ROTARY BLADES TO FORM SUCH

(71) Applicant: STRUCTA WIRE CORP., Vancouver (CA)

(72) Inventors: Abraham Jacob Sacks, Vancouver (CA); Jeffrey Leonard Sacks, Vancouver (CA); William Spilchen, White Rock (CA); Narcis Rugina, New Westminster (CA)

(73) Assignee: Structa Wire ULC, Vancouver (CA)

( * ) Notice: Subject to any disclaimer, the term of this patent is extended or adjusted under 35 U.S.C. 154(b) by 117 days.

(21) Appl. No.: 16/570,721

(22) Filed: Sep. 13, 2019

(65) Prior Publication Data

US 2020/0086373 A1 Mar. 19, 2020

Related U.S. Application Data

(60) Provisional application No. 62/731,613, filed on Sep. 14, 2018.

(51) Int. Cl.
*B21D 31/04* (2006.01)

(52) U.S. Cl.
CPC ..... *B21D 31/04* (2013.01); *Y10T 29/18* (2015.01)

(58) Field of Classification Search
CPC ..... B21D 31/046; Y10T 29/18
See application file for complete search history.

(56) References Cited

U.S. PATENT DOCUMENTS

| | | | |
|---|---|---|---|
| 320,163 | A | 6/1885 | Orr |
| 528,931 | A | 11/1894 | Eils |
| 553,306 | A | 1/1896 | Fordyce |
| 600,352 | A | 3/1898 | Bell |
| 617,458 | A | 1/1899 | Clancy |
| 651,590 | A | 6/1900 | Brightman |
| 659,416 | A | 10/1900 | Perry |
| D35,386 | S | 12/1901 | Reid |

(Continued)

FOREIGN PATENT DOCUMENTS

| | | | |
|---|---|---|---|
| CA | 2391269 | A1 | 1/2003 |
| CA | 2652919 | A1 | 5/2010 |

(Continued)

OTHER PUBLICATIONS

"Decorative Patterns Portfolio," retrieved from http://www.expac.com/decorative_patterns.htm, retrieved on, May 6, 2014, 2 pages.

(Continued)

*Primary Examiner* — Adam Krupicka
(74) *Attorney, Agent, or Firm* — Cozen O'Connor

(57) ABSTRACT

A rotary slitting blade for fabricating expanded metal products includes opposed end surfaces and an outer circumferential surface extending from one of the end surfaces to the other of the end surfaces. A plurality of notches are formed in each of the end surfaces. The notches include curved surfaces having convex curvatures that smoothly transition into one of the end surfaces and/or the outer circumferential surface. The rotary slitting blade improves the quality of a resulting expanded metal product by reducing or eliminating tears, cracks, and fractures in the expanded metal product.

15 Claims, 10 Drawing Sheets

(56) References Cited

U.S. PATENT DOCUMENTS

| | | | |
|---|---|---|---|
| 749,714 | A | 1/1904 | Barnes et al. |
| 792,039 | A | 6/1905 | Hollinger |
| 930,350 | A | 8/1909 | Clark |
| 934,081 | A | 9/1909 | Marks |
| 945,656 | A | 1/1910 | White |
| 948,414 | A | 2/1910 | Clark |
| 987,374 | A | 3/1911 | Kahn |
| 1,059,710 | A | 4/1913 | Chess |
| 1,087,511 | A | 2/1914 | Scammell |
| 1,112,649 | A | 10/1914 | Parr |
| 1,146,999 | A | 7/1915 | Burk |
| 1,147,000 | A | 7/1915 | Burk |
| 1,276,764 | A | 8/1918 | Holbrook |
| 1,314,777 | A | 9/1919 | White |
| 1,363,018 | A | 12/1920 | Sexton |
| 1,372,741 | A | 3/1921 | Dickinson |
| 1,405,579 | A | 2/1922 | Graham |
| 1,419,709 | A | 6/1922 | Ackermann |
| 1,434,915 | A | 11/1922 | Herbert |
| 1,436,866 | A | 11/1922 | Dickinson |
| 1,537,588 | A | 5/1925 | Curtis |
| 1,591,858 | A | 7/1926 | McClintic |
| 1,637,410 | A | 8/1927 | Clayton |
| 1,641,872 | A | 9/1927 | Southwell |
| 1,655,091 | A | 1/1928 | Curtis |
| 1,691,227 | A | 11/1928 | Cross |
| 1,701,125 | A | 2/1929 | Sagendorph |
| 1,704,608 | A | 3/1929 | Frank |
| 1,743,800 | A | 1/1930 | Pearce |
| 1,767,814 | A | 6/1930 | Punshon |
| 1,769,361 | A | 7/1930 | Earle |
| 1,801,530 | A | 4/1931 | Overmire |
| 1,802,779 | A | 4/1931 | Quade |
| 1,824,082 | A | 9/1931 | Hernandez |
| 1,837,393 | A | 12/1931 | Arey |
| 1,885,343 | A | 11/1932 | Greulich |
| 1,897,842 | A | 2/1933 | Herbest |
| 1,963,395 | A | 6/1934 | Zabriskie |
| 1,964,403 | A | 6/1934 | Loucks |
| 1,976,395 | A | 10/1934 | Herbest |
| 1,986,171 | A | 1/1935 | Wilson |
| 1,986,172 | A | 1/1935 | Wilson |
| 1,993,432 | A | 3/1935 | Roger |
| 2,022,363 | A | 11/1935 | Vertuno |
| 2,089,023 | A | 8/1937 | Hahn |
| 2,099,709 | A | 11/1937 | Spinosa |
| 2,101,074 | A | 12/1937 | Kotrbaty |
| 2,116,668 | A | 5/1938 | Cross |
| 2,121,962 | A | 6/1938 | Alexander |
| 2,131,670 | A | 9/1938 | Redding et al. |
| 2,136,071 | A | 11/1938 | Braden |
| 2,141,400 | A | 12/1938 | Mack |
| 2,150,606 | A | 3/1939 | McLellan |
| 2,180,486 | A | 11/1939 | Frederick |
| 2,184,353 | A | 12/1939 | Leary |
| 2,218,007 | A | 10/1940 | Miller |
| 2,219,806 | A | 10/1940 | Buttress |
| 2,236,141 | A | 3/1941 | Karelius |
| 2,241,991 | A | 5/1941 | Goldsmith |
| 2,243,723 | A | 5/1941 | Tench |
| 2,256,394 | A | 9/1941 | Lamel |
| 2,267,401 | A | 12/1941 | Gilmore |
| 2,269,869 | A | 1/1942 | Specht |
| 2,315,687 | A | 4/1943 | Burke |
| 2,322,654 | A | 6/1943 | Arlington |
| 2,322,657 | A | 6/1943 | Olsen |
| 2,375,303 | A | 5/1945 | Karelius |
| 2,455,666 | A | 12/1948 | Fournier |
| 2,474,778 | A | 6/1949 | Cross |
| 2,501,699 | A | 3/1950 | Glenroy |
| 2,565,292 | A | 8/1951 | Arthur |
| 2,572,483 | A | 10/1951 | Howle |
| 2,595,465 | A | 5/1952 | Keene et al. |
| 2,605,867 | A | 8/1952 | Goodwin |
| 2,621,160 | A | 12/1952 | Johnson et al. |
| 2,639,269 | A | 5/1953 | Dube |
| 2,645,824 | A | 7/1953 | Titsworth |
| 2,645,930 | A | 7/1953 | Stockton |
| 2,650,171 | A | 8/1953 | Schaaf |
| 2,668,606 | A | 2/1954 | King |
| 2,824,022 | A | 2/1958 | Glenn |
| 2,903,880 | A | 9/1959 | Johnson |
| 2,929,239 | A | 3/1960 | Dahlhauser et al. |
| 2,936,051 | A | 5/1960 | Martin |
| 2,996,160 | A | 8/1961 | Voight |
| 3,070,198 | A | 12/1962 | Boris |
| 3,073,066 | A | 1/1963 | Edwards et al. |
| 3,097,832 | A | 7/1963 | Murdock et al. |
| 3,145,001 | A | 8/1964 | Bruninga |
| 3,276,096 | A | 10/1966 | McAleer et al. |
| 3,299,785 | A | 1/1967 | James |
| 3,304,680 | A | 2/1967 | Birdwell |
| 3,342,003 | A | 9/1967 | Frank |
| 3,363,371 | A | 1/1968 | Fajardo |
| 3,475,876 | A | 11/1969 | Oroschakoff |
| 3,503,590 | A | 3/1970 | Buysens |
| 3,522,685 | A | 8/1970 | Oroschakoff |
| 3,581,649 | A | 6/1971 | Rauenhorst |
| 3,600,868 | A | 8/1971 | Wilson et al. |
| 3,660,215 | A | 5/1972 | Pawlicki |
| 3,672,022 | A | 6/1972 | York |
| 3,757,485 | A | 9/1973 | Vincens |
| 3,769,065 | A | 10/1973 | Dunn |
| 3,789,747 | A | 2/1974 | Farrar et al. |
| 3,831,333 | A | 8/1974 | Thulin et al. |
| 3,947,936 | A | 4/1976 | Wheadon |
| 3,954,180 | A | 5/1976 | Montonen et al. |
| 3,991,536 | A | 11/1976 | Rutherford |
| 4,000,241 | A | 12/1976 | Dunn |
| 4,003,178 | A | 1/1977 | Douthwaite |
| 4,011,704 | A | 3/1977 | Okonski |
| 4,020,612 | A | 5/1977 | Welch |
| 4,056,195 | A | 11/1977 | Keith |
| 4,085,558 | A | 4/1978 | Albrecht |
| 4,099,386 | A | 7/1978 | Sagasta |
| 4,159,302 | A | 6/1979 | Greve et al. |
| 4,179,264 | A | 12/1979 | Vancauwenberghe |
| 4,226,061 | A | 10/1980 | Day |
| 4,245,926 | A | 1/1981 | Asszonyi et al. |
| 4,248,022 | A | 2/1981 | Walker |
| 4,255,489 | A | 3/1981 | Nielsen |
| 4,297,866 | A | 11/1981 | Sakauye et al. |
| 4,343,127 | A | 8/1982 | Greve et al. |
| 4,347,155 | A | 8/1982 | Jenkins |
| 4,385,476 | A | 5/1983 | Slager |
| 4,396,685 | A | 8/1983 | Jury |
| 4,447,380 | A | 5/1984 | Shannon et al. |
| 4,464,885 | A | 8/1984 | Palacio et al. |
| 4,485,606 | A | 12/1984 | Gottlieb |
| 4,510,727 | A | 4/1985 | Jury |
| 4,512,736 | A | 4/1985 | Wader |
| 4,513,551 | A | 4/1985 | Gauffin et al. |
| 4,520,073 | A | 5/1985 | Randolph et al. |
| 4,522,860 | A | 6/1985 | Scott et al. |
| 4,525,388 | A | 6/1985 | Rehder et al. |
| 4,539,787 | A | 9/1985 | Ritter et al. |
| 4,545,170 | A | 10/1985 | Shirey |
| 4,551,957 | A | 11/1985 | Madray |
| 4,559,749 | A | 12/1985 | Nusbaum |
| 4,559,752 | A | 12/1985 | Kieffer |
| 4,571,914 | A | 2/1986 | Stoyanoff |
| 4,580,379 | A | 4/1986 | Nusbaum |
| 4,621,397 | A | 11/1986 | Schrenk |
| 4,658,552 | A | 4/1987 | Mulford |
| 4,669,243 | A | 6/1987 | Gore et al. |
| 4,691,493 | A | 9/1987 | Larsen |
| 4,693,048 | A | 9/1987 | Guetersloh |
| 4,695,033 | A | 9/1987 | Imaeda et al. |
| 4,713,921 | A | 12/1987 | Minialoff et al. |
| 4,720,957 | A | 1/1988 | Madray |
| 4,722,861 | A | 2/1988 | Sawaide |
| 4,734,337 | A | 3/1988 | Patton |
| 4,793,113 | A | 12/1988 | Bodnar |
| 4,803,128 | A | 2/1989 | Bender |

(56) References Cited

U.S. PATENT DOCUMENTS 4,819,395 A 4/1989 Sugita et al.
4,841,705 A 6/1989 Fuhrer
4,843,786 A 7/1989 Walkinshaw et al.
4,893,569 A 1/1990 Hansen
4,897,007 A 1/1990 Chen et al.
4,968,185 A 11/1990 Leibhard et al.
5,002,696 A 3/1991 White
5,027,572 A 7/1991 Purcell et al.
5,029,779 A 7/1991 Bruggeman
5,081,814 A 1/1992 Singletary et al.
5,136,765 A * 8/1992 Tanaka ..... B21D 31/046 29/6.1
5,157,883 A 10/1992 Meyer
5,157,887 A 10/1992 Watterworth
5,231,811 A 8/1993 Andrepont et al.
5,249,400 A 10/1993 Turner
5,287,673 A 2/1994 Kreikemeier
5,305,941 A 4/1994 Kent et al.
5,321,928 A 6/1994 Warneke
5,360,771 A 11/1994 Delvaux et al.
5,363,621 A 11/1994 Kroll et al.
5,410,852 A 5/1995 Edgar et al.
5,418,013 A 5/1995 Detrick et al.
5,439,518 A 8/1995 Francis et al.
5,481,843 A 1/1996 Kreikemeier
5,527,590 A 6/1996 Priluck
5,528,876 A 6/1996 Lu
5,529,192 A 6/1996 Conen et al.
5,540,023 A 7/1996 Jaenson
5,570,953 A 11/1996 Dewall
5,590,505 A 1/1997 Bogle
5,592,800 A 1/1997 Koo et al.
5,605,024 A 2/1997 Sucato et al.
5,617,686 A 4/1997 Gallagher
5,625,995 A 5/1997 Martin
5,685,116 A 11/1997 Bradshaw et al.
5,697,195 A 12/1997 Maylon
5,716,718 A 2/1998 Lai
5,732,520 A 3/1998 Maietta
5,753,036 A 5/1998 Hornaman et al.
5,755,545 A 5/1998 Banks
5,761,864 A 6/1998 Nonoshita
5,778,626 A 7/1998 Hellsten
5,826,388 A 10/1998 Irving
5,836,135 A 11/1998 Hagan et al.
5,842,276 A 12/1998 Asher et al.
5,845,379 A 12/1998 Steffensen
5,852,908 A 12/1998 Nankin
5,867,949 A 2/1999 Untiedt
5,867,962 A 2/1999 Scott et al.
5,927,035 A 7/1999 Haytayan
5,937,600 A 8/1999 Larson
5,943,775 A 8/1999 Lanahan et al.
5,979,131 A 11/1999 Remmele et al.
5,979,787 A 11/1999 Scarpa
6,035,595 A 3/2000 Anderson
6,047,510 A 4/2000 Gallaway
6,050,048 A 4/2000 Hellsten
6,052,959 A 4/2000 Labrosse
6,108,991 A 8/2000 Hagan et al.
6,149,701 A 11/2000 Ellingson
6,205,740 B1 3/2001 Ekerholm et al.
6,207,256 B1 3/2001 Tashiro
6,254,981 B1 7/2001 Castle
6,263,629 B1 7/2001 Brown
6,305,432 B1 10/2001 Sacks et al.
6,330,777 B1 12/2001 Padley
6,343,452 B1 2/2002 Holden
6,363,679 B1 4/2002 Rutherford
6,390,438 B1 5/2002 McManus
6,412,249 B1 7/2002 Boyer et al.
6,447,928 B2 9/2002 Suitts
6,460,393 B1 10/2002 Sundhagen
6,481,175 B2 11/2002 Potter et al.
6,584,735 B2 7/2003 Burton
6,609,344 B2 8/2003 Saldana
6,617,386 B2 9/2003 Lelli et al.
6,658,809 B2 12/2003 Collins
6,668,501 B2 12/2003 Adebar et al.
6,754,997 B2 6/2004 Bonin
6,758,743 B1 7/2004 Grosskrueger
6,820,387 B2 11/2004 Sacks et al.
6,823,636 B2 11/2004 Mahoney
6,910,311 B2 6/2005 Lindberg et al.
6,920,734 B2 7/2005 Elderson
6,938,383 B2 9/2005 Morris et al.
6,993,883 B2 2/2006 Belanger
7,117,649 B2 10/2006 Morris et al.
7,143,551 B2 12/2006 Corwin
7,174,688 B2 2/2007 Higginbotham
7,179,165 B2 2/2007 Cook
7,195,556 B1 3/2007 Fichtelman
7,231,746 B2 6/2007 Bodnar
7,287,356 B2 10/2007 Sacks et al.
7,368,175 B2 5/2008 Neth
7,381,261 B1 6/2008 Nelson
7,497,903 B2 3/2009 Wang et al.
7,517,590 B2 4/2009 Wagner
7,538,152 B2 5/2009 Bohler et al.
7,565,775 B2 7/2009 Cooper et al.
7,604,534 B2 10/2009 Hill
7,654,051 B2 2/2010 Pollack
7,690,167 B2 4/2010 Antonic
7,735,294 B2 6/2010 Moody et al.
7,788,868 B2 9/2010 Pollack
7,820,302 B2 10/2010 Krettenauer
7,861,488 B2 1/2011 Giles et al.
7,866,112 B2 1/2011 Edmondson
7,921,537 B2 4/2011 Rodlin
7,955,460 B2 6/2011 Bennett et al.
8,074,416 B2 12/2011 Andrews
8,084,117 B2 12/2011 Lalvani
8,171,696 B2 5/2012 Powers et al.
8,225,581 B2 7/2012 Strickland et al.
8,234,836 B2 8/2012 Anderson
8,276,321 B2 10/2012 Bell
8,281,551 B2 10/2012 Leek et al.
8,578,576 B2 11/2013 Castricum
8,615,957 B1 12/2013 Sacks et al.
8,696,781 B2 4/2014 Wallner et al.
8,720,142 B2 5/2014 Spilchen
9,708,816 B2 7/2017 Sacks et al.
2003/0029129 A1 2/2003 Walters
2003/0055147 A1 3/2003 Lelli et al.
2003/0126806 A1 7/2003 Ellis
2004/0000118 A1 1/2004 Fuerle
2004/0134158 A1 7/2004 Farrell et al.
2005/0011156 A1 1/2005 Tseng
2005/0055953 A1 3/2005 Sacks et al.
2005/0108978 A1 5/2005 Strickland et al.
2006/0075715 A1 4/2006 Serpigo et al.
2006/0265997 A1 11/2006 Collins et al.
2007/0072541 A1 3/2007 Daniels et al.
2007/0119106 A1 5/2007 Sacks et al.
2007/0175145 A1 8/2007 Sacks et al.
2007/0193150 A1 8/2007 Carlson
2007/0243820 A1 10/2007 Ohagin
2008/0250738 A1 10/2008 Howchin
2009/0013633 A1 1/2009 Aubuchon
2009/0186570 A1 7/2009 Riggins
2009/0203308 A1 8/2009 Ohagin et al.
2010/0126097 A1 5/2010 Powers
2010/0229501 A1 9/2010 Bodnar
2010/0287872 A1 11/2010 Bodnar
2010/0300645 A1 12/2010 Glover
2011/0021663 A1 1/2011 Sacks et al.
2012/0028563 A1 2/2012 Sacks et al.
2012/0186190 A1 7/2012 Powers et al.
2012/0279162 A1 11/2012 Strickland et al.
2013/0333172 A1 12/2013 Wallner et al.

(56) References Cited

U.S. PATENT DOCUMENTS

| | | | |
|---|---|---|---|
| 2015/0240486 | A1 | 8/2015 | Sacks et al. |
| 2015/0308118 | A1 | 10/2015 | Spilchen et al. |

FOREIGN PATENT DOCUMENTS

| | | | |
|---|---|---|---|
| CH | 658489 | A5 | 11/1986 |
| DE | 4019281 | A1 | 12/1991 |
| EP | 0579007 | A2 | 1/1994 |
| EP | 0637658 | A1 | 2/1995 |
| EP | 0691441 | A1 | 1/1996 |
| FR | 2421695 | A1 | 11/1979 |
| FR | 2584957 | A1 | 1/1987 |
| GB | 311636 | A | 5/1929 |
| GB | 414277 | A | 8/1934 |
| GB | 2201184 | A | 8/1988 |
| JP | 7233611 | A | 9/1995 |
| JP | 11181989 | A | 7/1999 |
| JP | 2001065140 | A | 3/2001 |
| JP | 2003013577 | A | 1/2003 |
| JP | 4293848 | B2 | 4/2009 |
| WO | 2000053356 | A1 | 9/2000 |
| WO | 2010059631 | A1 | 5/2010 |
| WO | 2012024768 | A1 | 3/2012 |

OTHER PUBLICATIONS

"Expanded Metal Terminology," retrieved from http://www.expac.com/glossary.htm, retrieved on, May 6, 2014, 2 pages.
"HVAC Filter Industry," retrieved from http://www.expac.com/hvac.htm, retrieved on, May 6, 2014, 1 page.
"Standard Pattern Portfolio," retrieved from http://www.expac.com/standardportfolio.htm, retrieved on, May 6, 2014, 2 pages.
Andrade et al., "Lateral-torsional buckling of singly symmetric web-tapered thin-walled I-beams: 1D model vs. shell FEA," Computers and Structures 85:1343-1359, 2007.
Blomberg et al., "Heat Transmission Through Walls with Slotted Steel Studs," Thermal Envelopes VII/Wall Systems—Principles, pp. 621-628, 1998.
Demandit, "Interior/Exterior Acrylic Coating in Standard and Custom Colors," Dryvit Systems, Inc., 1990, 1 page.
Hoglund et al., "Slotted steel studs to reduce thermal bridges in insulated walls," Thin-Walled Structures 32:81-109, 1998.
International Search Report, for International Application No. PCT/US2010/050421, dated Feb. 9, 2011, 11 pages.
International Search Report, dated Sep. 30, 2016, for International Application No. PCT/CA2016/050900, 3 pages.
Katz et al., "Handbook of Fillers for Plastics," 1987, 2 pages.
Metallic Demandit, "Interior/Exterior Acrylic Coating with a Metallic Appearance," Dryvit Systems, 1989, 1 page.
National Association of Architectural Metal Manufacturers, EMMA 557-99, "Standards for Expanded Metal," NAAMM, 1999, 18 pages.
Quarzite, "Exterior and Interior Quartz Aggregate Finish," Dryvit Systems, 1991, 1 page.
Sacks et al., "Energy Efficient Building Environmental Control Apparatus and Method," Office Action, dated Jul. 8, 2011, for U.S. Appl. No. 12/847,923, 17 pages.
Sacks et al., "Energy Efficient Building Environmental Control Apparatus and Method," Preliminary Amendment, filed Sep. 15, 2010, for U.S. Appl. No. 12/847,923, 11 pages.
Sacks et al., "Framing Members To Enhance Thermal Characteristics of Walls," Amendment filed Nov. 4, 2015, for U.S. Appl. No. 14/681,919, 20 pages.
Sacks et al., "Framing Members To Enhance Thermal Characteristics of Walls," Office Action dated Aug. 4, 2015, for U.S. Appl. No. 14/681,919, 26 pages.
Sacks et al., "Framing Members To Enhance Thermal Characteristics of Walls," Office Action dated Oct. 9, 2014, for U.S. Appl. No. 14/189,548, 44 pages.
Sacks et al., "Framing Members To Enhance Thermal Characteristics of Walls," Office Action, dated Feb. 4, 2016, for U.S. Appl. No. 14/681,919, 19 pages.
Sacks et al., "Framing Members To Enhance Thermal Characteristics of Walls," U.S. Appl. No. 14/189,548, filed Feb. 25, 2014, 45 pages.
Sacks et al., "Framing Members To Enhance Thermal Characteristics of Walls," U.S. Appl. No. 14/681,919, filed Apr. 8, 2015, 80 pages.
Sacks et al., "Lath With Barrier Material," Amendment, filed Apr. 29, 2010, for U.S. Appl. No. 11/679,562, 4 pages.
Sacks et al., "Lath With Barrier Material," Office Action, dated Aug. 25, 2010, for U.S. Appl. No. 11/679,562, 12 pages.
Sacks et al., "Lath With Barrier Material," Office Action, dated Feb. 3, 2010, for U.S. Appl. No. 11/679,562, 15 pages.
Sacks et al., "Lath With Barrier Material," Supplemental Amendment, filed Jun. 15, 2010, for U.S. Appl. No. 11/679,562, 5 pages.
Sacks et al., "Light Weight Aggregate Composition," Office Action, dated Nov. 23, 2010, for U.S. Appl. No. 12/508,384, 8 pages.
Sacks et al., "Light-Weight Metal Stud and Method of Manufacture," Amendment filed Aug. 7, 2013, for U.S. Appl. No. 13/767,764, 14 pages.
Sacks et al., "Light-Weight Metal Stud and Method of Manufacture," Amendment, filed Apr. 8, 2016, for U.S. Appl. No. 14/812,952, 20 pages.
Sacks et al., "Light-Weight Metal Stud and Method of Manufacture," Notice of Allowance, dated Oct. 17, 2013, for U.S. Appl. No. 13/767,764, 21 pages.
Sacks et al., "Light-Weight Metal Stud and Method of Manufacture," Office Action dated May 14, 2013, for U.S. Appl. No. 13/767,764, 12 pages.
Sacks et al., "Light-Weight Metal Stud and Method of Manufacture," Office Action, dated Jan. 11, 2016, for U.S. Appl. No. 14/812,952, 14 pages.
Sacks et al., "Light-Weight Metal Stud and Method of Manufacture," Office Action, dated May 2, 2016, for U.S. Appl. No. 14/812,952, 28 pages.
Sacks et al., "Light-Weight Metal Stud and Method of Manufacture," U.S. Appl. No. 14/812,952, filed Jul. 29, 2015, 39 pages.
Sacks et al., "Twin Track Wire Lath," Amendment, filed Dec. 4, 2006, for U.S. Appl. No. 10/663,419, 22 pages.
Sacks et al., "Twin Track Wire Lath," Amendment, filed Jun. 18, 2007, for U.S. Appl. No. 10/663,419, 6 pages.
Sacks et al., "Twin Track Wire Lath," Amendment, filed Mar. 9, 2007, for U.S. Appl. No. 10/663,419, 10 pages.
Sacks et al., "Twin Track Wire Lath," Amendment, filed Nov. 12, 2005, for U.S. Appl. No. 10/663,419, 12 pages.
Sacks et al., "Twin Track Wire Lath," Amendment, filed Oct. 25, 2004, for U.S. Appl. No. 10/663,419, 14 pages.
Sacks et al., "Twin Track Wire Lath," Notice of Allowance, dated Jul. 26, 2007, for U.S. Appl. No. 10/663,419, 5 pages.
Sacks et al., "Twin Track Wire Lath," Office Action, dated Apr. 10, 2007, for U.S. Appl. No. 10/663,419, 9 pages.
Sacks et al., "Twin Track Wire Lath," Office Action, dated Feb. 9, 2005, for U.S. Appl. No. 10/663,419, 10 pages.
Sacks et al., "Twin Track Wire Lath," Office Action, dated Jun. 7, 2004, for U.S. Application No. 10/663,419, 12 pages.
Sacks et al., "Twin Track Wire Lath," Office Action, dated Sep. 12, 2005, for U.S. Appl. No. 10/663,419, 10 pages.
Sacks et al., "Twin Track Wire Lath," Office Action, dated Sep. 5, 2006, for U.S. Appl. No. 10/663,419, 15 pages.
Sacks et al., "Twin Track Wire Lath," Supplemental Amendment, filed Nov. 17, 2005, for U.S. Appl. No. 10/663,419, 19 pages.
Spilchen et al., "Reinforcing Insert Article, Kit and Method," Amendment filed Dec. 18, 2015 for U.S. Appl. No. 14/795,731, 20 pages.
Spilchen et al., "Reinforcing Insert Article, Kit and Method," Office Action filed Sep. 18, 2015 for U.S. Appl. No. 14/795,731, 25 pages.
Spilchen et al., "Reinforcing Insert Article, Kit and Method," U.S. Appl. No. 61/903,513, filed Nov. 13, 2013, 26 pages.
Wallner et al., "Expanded Metal and Process of Making the Same," Preliminary Amendment filed Oct. 16, 2013, for U.S. Appl. No. 13/970,472, 12 pages.

(56) References Cited

OTHER PUBLICATIONS

Spilchen et al., "Reinforcing Insert Article, Kit and Method," Office Action, dated Mar. 18, 2016, for U.S Appl. No. 14/795,731, 17 pages.
Wallner et al., "Expanded Metal and Process of Making the Same," U.S. Appl. No. 13/970,472, filed Aug. 19, 2013, 27 pages.

* cited by examiner

FIG.6D
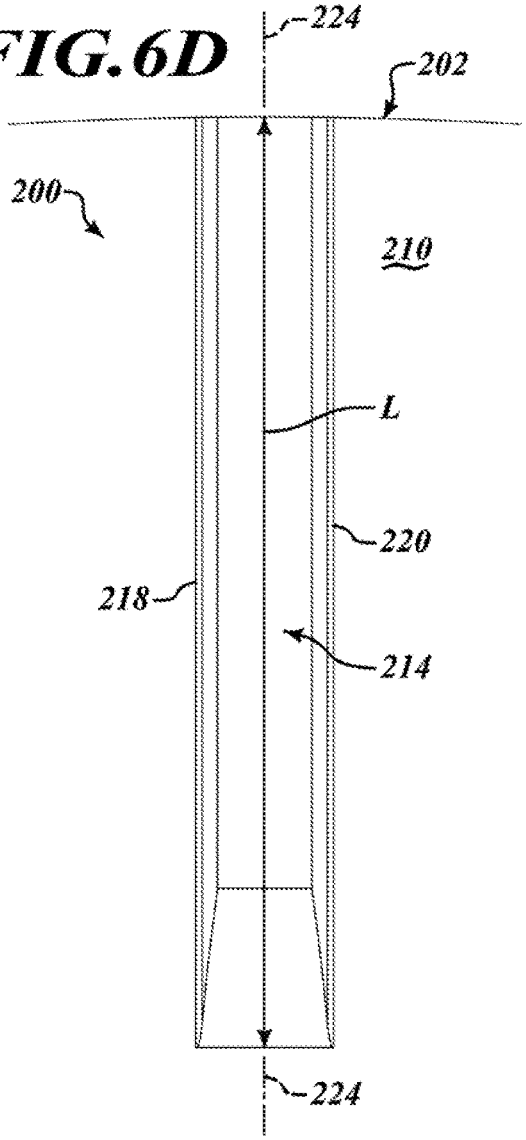
FIG.6E
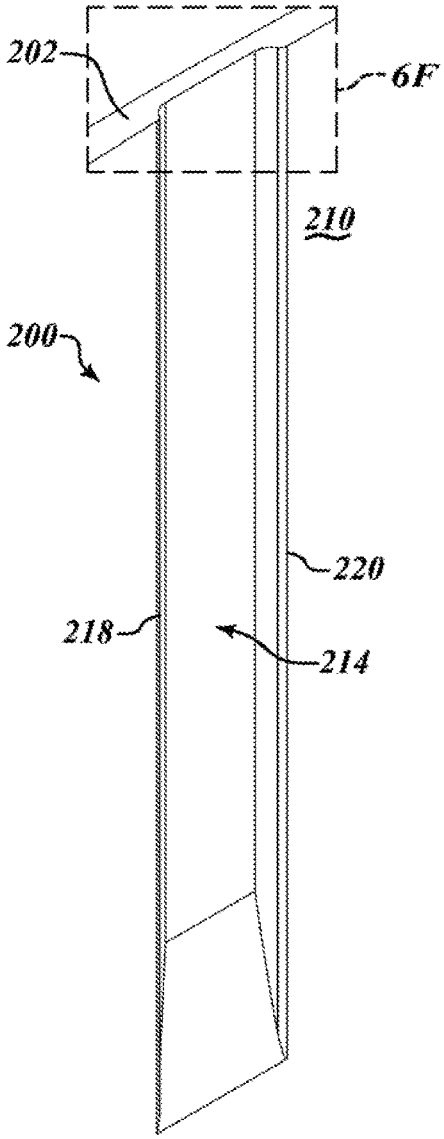
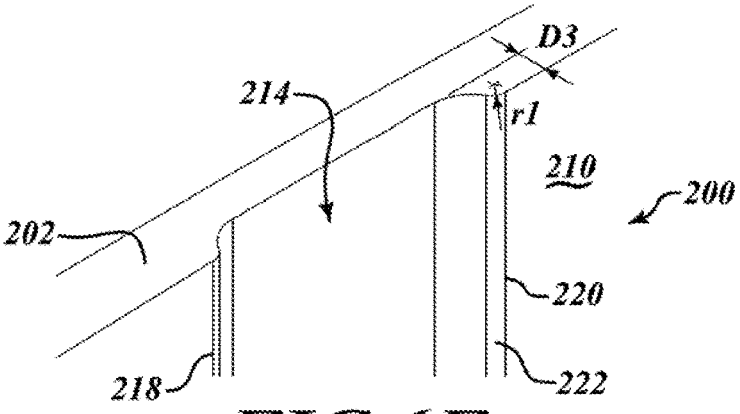
FIG.6F

FIG. 7A
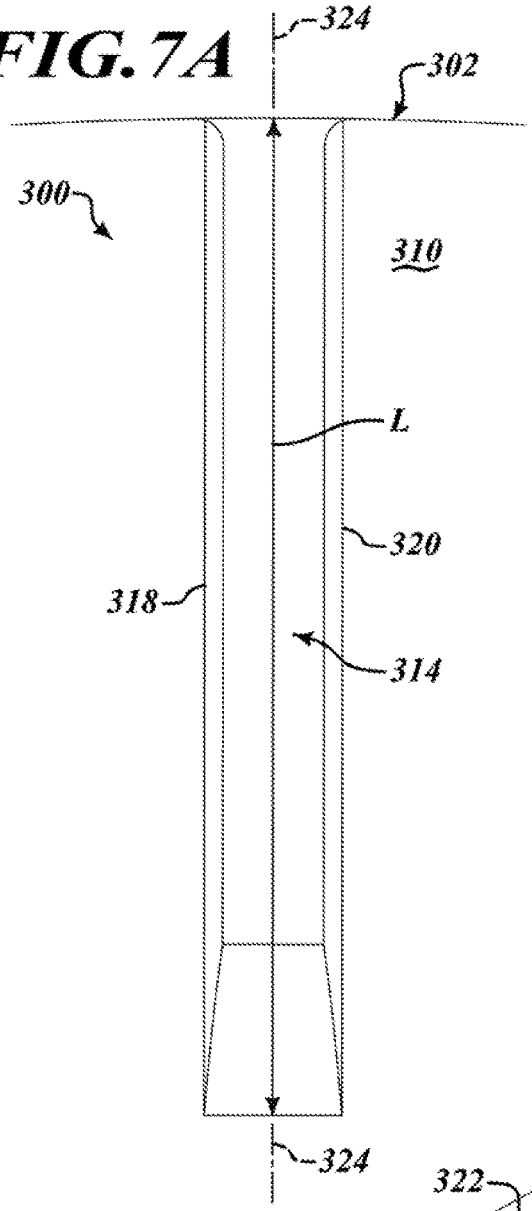
FIG. 7B
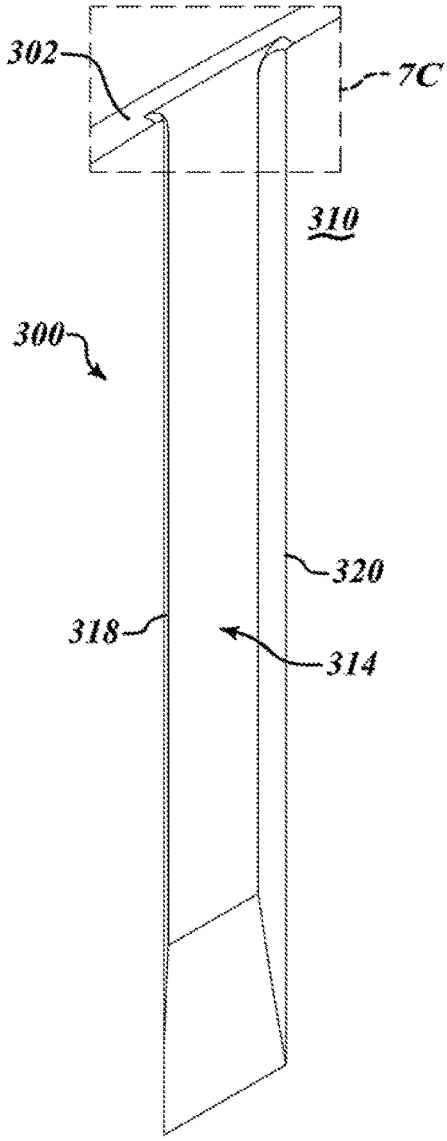
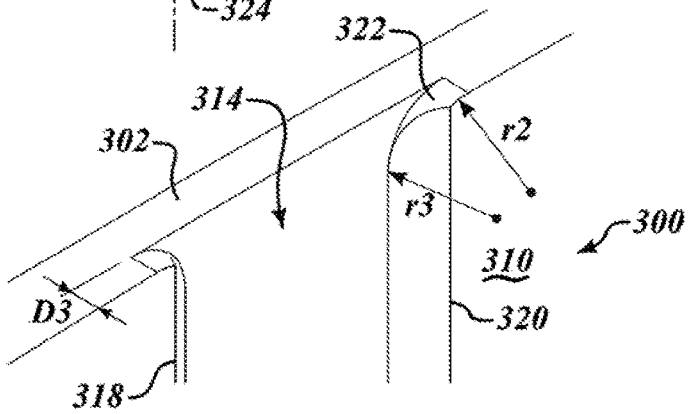
FIG. 7C

FIG.8A
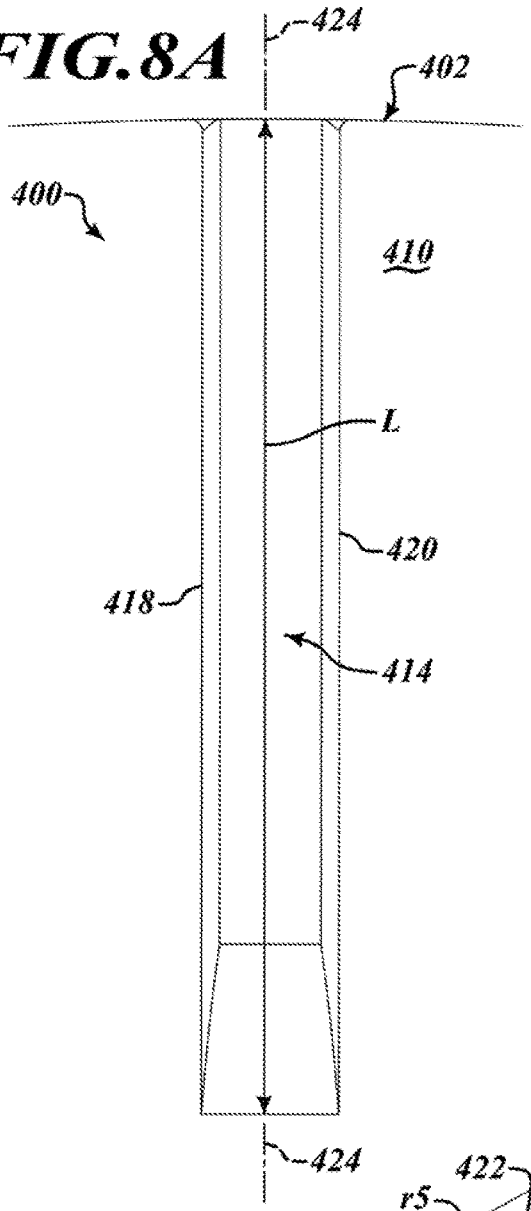
FIG.8B
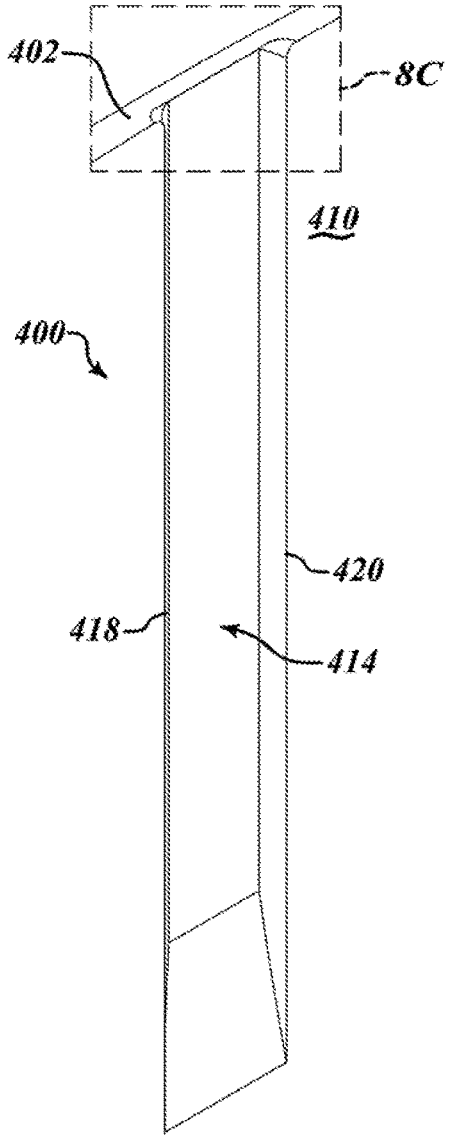
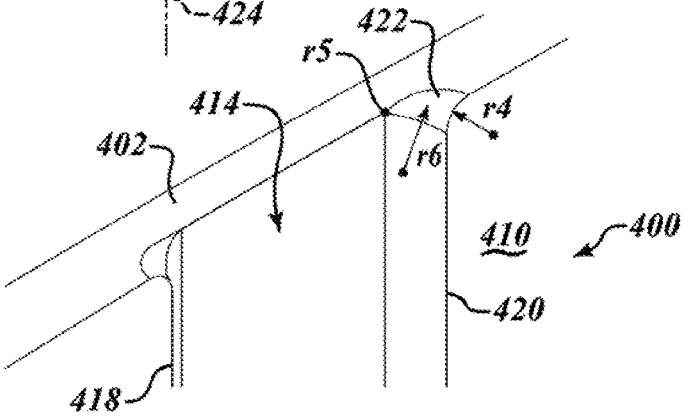
FIG.8C

FIG.9A
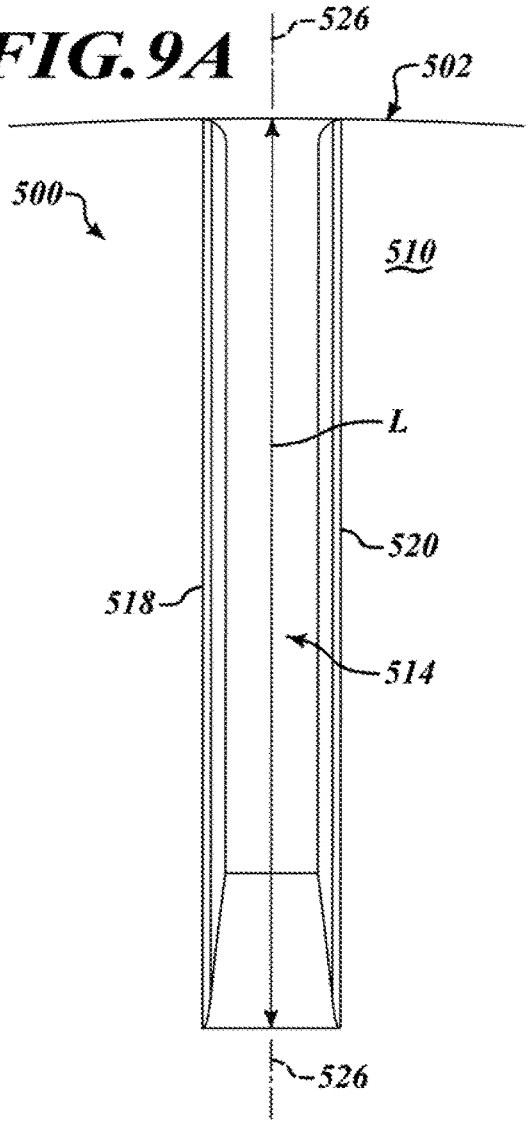
FIG.9B
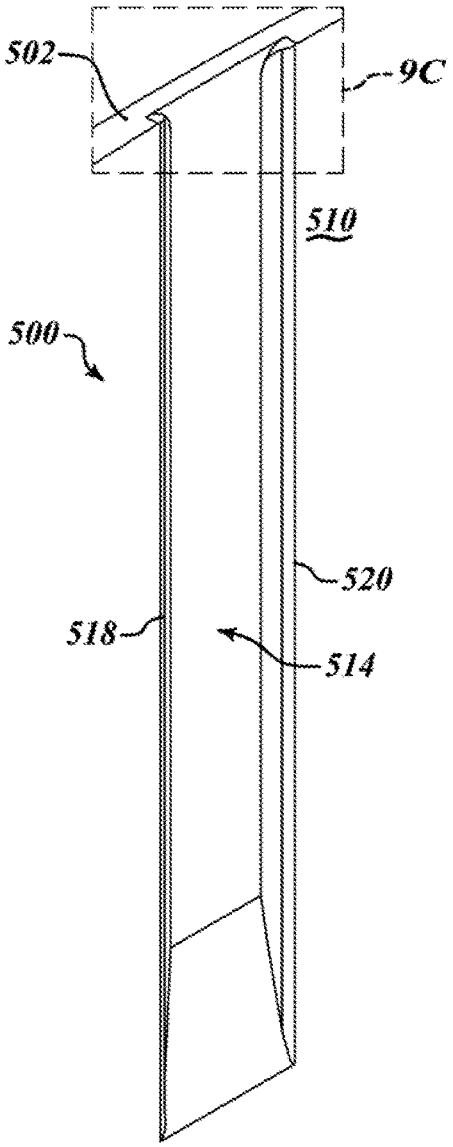
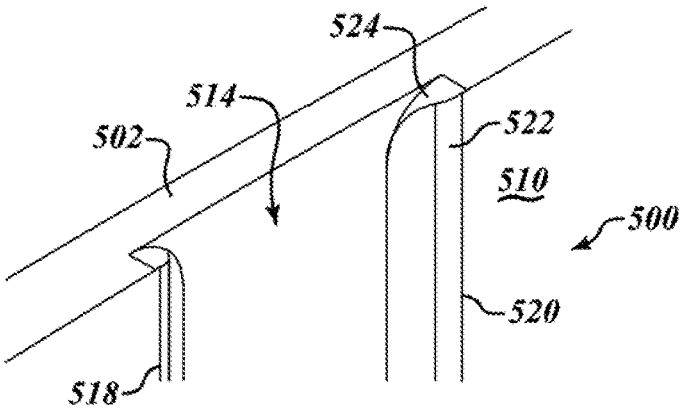
FIG.9C

EXPANDED METAL FORMED USING ROTARY BLADES AND ROTARY BLADES TO FORM SUCH

TECHNICAL FIELD

The present disclosure relates generally to expanded metals, and more specifically to expanded metals formed using rotary slitting blades.

BACKGROUND

Description of the Related Art

Expanded metal laths are created by forming a plurality of slits through a metal sheet or metal strip in a defined pattern. Exposing the slitted metal sheet or strip to a tensile force causes the slits to separate and form openings in the lath. Depending on the slit pattern, the openings may have a number of shapes, such as diamond shapes. Expanded metal lath is an extremely efficient material since the lath is monolithic and does not require apparatus or extra operations to attach individual strands together such as welding or twisting. Extremely light meshes may be produced.

An expanded metal lath can achieve efficient material usage, with no waste or unnecessary material being required. Since the dimensions of the strands in the expanded metal lath are a function of the slit pattern, the expanded metal lath can be fabricated with different dimensions across the width of the lath. For example, the width of the strands in sections where fasteners will be used to couple the lath to other structures may be greater than the width of the webs or strands in sections where fasteners will not be used.

One method of fabricating expanded metal products uses rotary blades to slit the metal. Rotary slitting systems often include two shafts, each carrying a respective set of slitting blades and a respective set of spacer rings, the slitting blades and spacer rings alternating along the length of the respective shaft so that the slitting blades are spaced apart from one another by the spacer rings. The slitting blades of the two shafts often oppose and interlock with one another.

Each individual rotary slitting blade has a thickness, or a width, that affects a strand width of the resulting expanded metal. Each individual rotary slitting blade also has a series of notches formed in its outer surface that interrupt a slitting action of the blade to leave sections of the resulting expanded metal where two adjacent strands are bonded to one another, referred to as bond sections. Each individual rotary slitting blade can also have a series of features formed in its outer surface that push adjacent strands apart from one another between their bond sections to create the openings in the expanded metal product.

Using rotary blades to fabricate expanded metal products can provide advantages over other methods of fabricating expanded metal products. For example, such techniques can fabricate expanded metal products from sheet metal at a speed of about 200 feet per minute, can operate smoothly because they do not use reciprocating masses, and can operate with low maintenance costs.

BRIEF SUMMARY

An expanded metal product may be summarized as comprising: a plurality of openings, each of the openings delineated by a respective set of first, second, third, and fourth sheet metal strands monolithically joined to one another by a respective set of first, second, third, and fourth bond sections, each of the openings having a respective first dimension along a first axis of the opening extending from the first bond section to the third bond section and a respective second dimension along a second axis of the opening extending from the second bond section to the fourth bond section, the second axis of the opening perpendicular to the first axis of the opening; wherein fewer than 70% of the bond sections have optically detectable fractures.

The bond sections may be planar with respect to the rest of the expanded metal product. The expanded metal product may be a unitary piece of metal and the first, second, third, and fourth sheet metal strands of each set may be monolithically joined to one another. A thickness of the sheet metal strands may be between 0.015 inches and 0.030 inches.

A rotary blade may be summarized as comprising: a cylindrical body having a first end face, a second end face opposite the first end face, and an outer circumferential surface that extends from the first end face to the second end face; a first plurality of notches in the first end face that extend radially toward and that intersect the outer circumferential surface, wherein each of the first plurality of notches includes a respective curved surface having a convex curvature that smoothly transitions into the first end face; and a second plurality of notches in the second end face that extend radially toward and that intersect the outer circumferential surface, wherein each of the second plurality of notches includes a respective curved surface having a convex curvature that smoothly transitions into the second end face.

Each of the curved surfaces may have a radius of curvature of between 0.004 inches and 0.010 inches. Each of the curved surfaces may have a radius of curvature that is constant along an entire length of the curved surface.

A rotary blade may be summarized as comprising: a cylindrical body having a first end face, a second end face opposite the first end face, and an outer circumferential surface that extends from the first end face to the second end face; a first plurality of notches in the first end face that extend radially toward and that intersect the outer circumferential surface, wherein each of the first plurality of notches includes a respective curved surface having a convex curvature that smoothly transitions into the outer circumferential surface; and a second plurality of notches in the second end face that extend radially toward and that intersect the outer circumferential surface, wherein each of the second plurality of notches includes a respective curved surface having a convex curvature that smoothly transitions into the outer circumferential surface.

Each of the curved surfaces may have a constant curvature along an entire length of the curved surface. Each of the curved surfaces may have a radius of curvature of between 0.005 inches and 0.020 inches. Each of the curved surfaces may have a first radius of curvature at a first location adjacent to the outer circumferential surface and a second radius of curvature at a second location opposite the first location, wherein the first radius of curvature is smaller than the second radius of curvature. The first radius of curvature may be about 0.005 inches and the second radius of curvature may be about 0.020 inches. Each of the curved surfaces may have a first radius of curvature at a first location adjacent to the outer circumferential surface and a second radius of curvature at a second location opposite the first location, wherein the first radius of curvature is larger than the second radius of curvature. The first radius of curvature may be about 0.010 inches and the second radius of curvature may be about 0.000 inches. Each of the curved surfaces may have both a convex curvature and a concave curvature.

A method of making an expanded metal product may be summarized as comprising: rotating a first plurality of rotary blades in a first rotational direction and a second plurality of rotary blades in a second rotational direction opposite to the first rotational direction, each of the rotary blades including a plurality of notches, each of the notches including a curved surface having a convex curvature that smoothly transitions into an outer surface of the respective rotary blade; and passing a piece of sheet metal between the first and second pluralities of rotary blades so that the rotary blades form slits through the piece of sheet metal and bond sections at ends of the slits, wherein fewer than 70% of the bond sections have optically detectable fractures.

The method may further comprise applying tension to the piece of sheet metal in a direction transverse to the slits to expand the piece of sheet metal. The method may further comprise, after passing the piece of sheet metal between the first and second pluralities of rotary blades and applying tension to the piece of sheet metal in a direction transverse to the slits, flattening the piece of sheet metal.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements, and may have been solely selected for ease of recognition in the drawings.

FIG. 6D illustrates a close-up view of a portion of FIG. 6A, according to at least one illustrated implementation.

FIG. 6E illustrates a close-up view of a portion of FIG. 6C, according to at least one illustrated implementation.

FIG. 6F illustrates a close-up view of a portion of FIG. 6E, according to at least one illustrated implementation.

FIG. 7A illustrates a close-up view, corresponding to that of FIG. 6D, of a portion of another rotary slitting blade, according to at least one illustrated implementation.

FIG. 7B illustrates a close-up perspective view, corresponding to that of FIG. 6E, of a portion of the rotary slitting blade of FIG. 7A, according to at least one illustrated implementation.

FIG. 7C illustrates a close-up view of a portion of FIG. 7B, according to at least one illustrated implementation.

FIG. 8A illustrates a close-up view, corresponding to that of FIG. 6D, of a portion of another rotary slitting blade, according to at least one illustrated implementation.

FIG. 8B illustrates a close-up perspective view, corresponding to that of FIG. 6E, of a portion of the rotary slitting blade of FIG. 8A, according to at least one illustrated implementation.

FIG. 8C illustrates a close-up view of a portion of FIG. 8B, according to at least one illustrated implementation.

FIG. 9A illustrates a close-up view, corresponding to that of FIG. 6D, of a portion of another rotary slitting blade, according to at least one illustrated implementation.

FIG. 9B illustrates a close-up perspective view, corresponding to that of FIG. 6E, of a portion of the rotary slitting blade of FIG. 9A, according to at least one illustrated implementation.

FIG. 9C illustrates a close-up view of a portion of FIG. 9B, according to at least one illustrated implementation.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with the technology have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

The headings and Abstract of the Disclosure provided herein are for convenience only and do not limit the scope or meaning of the implementations.

Figure 1:
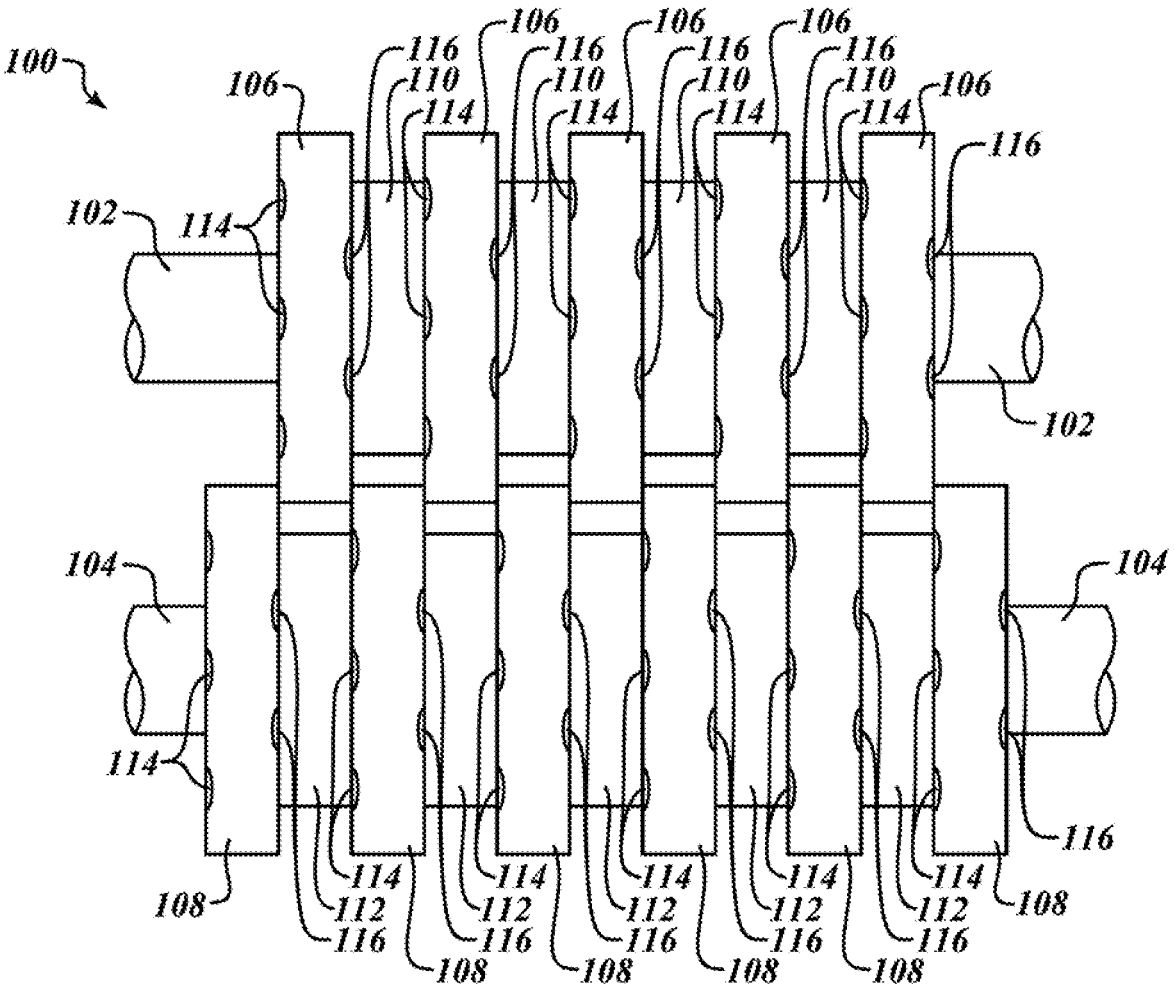
FIG. 1 illustrates a front elevational view of a pair of rotors with associated rotary slitting blades for forming expanded metal products, according to at least one illustrated implementation.

FIG. 1 shows a rotary slitting system 100. Rotary slitting system 100 includes a first rotor 102 and a second rotor 104 that is spaced apart from, and extends in a direction parallel to, the first rotor 102. Rotary slitting system 100 also includes a first plurality of rotary slitting blades 106 mounted on the first rotor 102 such that each of the first plurality of rotary slitting blades 106 rotates in unison with the first rotor 102 about a central longitudinal axis of the first rotor 102. Rotary slitting system 100 also includes a second plurality of rotary slitting blades 108 mounted on the second rotor 104 such that each of the second plurality of rotary slitting blades 108 rotates in unison with the second rotor 104 about a central longitudinal axis of the second rotor 104.

The rotary slitting system 100 also includes a first plurality of spacer rings 110 mounted on the first rotor 102 such that the first plurality of rotary slitting blades 106 alternates with the first plurality of spacer rings 110 along a length of the first rotor 102. The rotary slitting system 100 also includes a second plurality of spacer rings 112 mounted on the second rotor 104 such that the second plurality of rotary slitting blades 108 alternates with the second plurality of spacer rings 112 along a length of the second rotor 104. Each of the first plurality of spacer rings 110 and each of the second plurality of spacer rings 112 comprises a disk having an outer diameter smaller than an outer diameter of the adjacent rotary slitting blades 106 or 108, respectively.

As also shown in FIG. 1, each of the first plurality of rotary slitting blades 106 and each of the second plurality of rotary slitting blades 108 comprises a disk having a circumferential outer surface and two opposed end surfaces or end faces. Further, each of the rotary slitting blades 106, 108 includes a first plurality of slots or notches 114 that extend into and along a first end surface thereof, and a second plurality of slots or notches 116 that extend into and along a second end surface thereof opposite the first surface thereof. Each of the notches 114 and 116 has one or more of the features described herein with respect to the notches illustrated in FIGS. 6A-6F, 7A-7C, 8A-8C, and/or 9A-9C.

Each of the notches 114 and 116 extends into and along and in a radial direction through the respective end surface of the respective rotary slitting blade 106 or 108, to the outer circumferential surface thereof. All of the blades 106 and 108 have the same number of notches 114 in their first end surfaces as one another and the same number of notches 116 in their second end surfaces as one another. Further, each blade 106, 108 has the same number of notches 114 in its first end surface as it has notches 116 in its second end surface.

The notches 114 of each of the rotary slitting blades 106, 108 are equally spaced apart from one another around the respective end surfaces of the blades 106, 108. Similarly, the notches 116 of each of the rotary slitting blades 106, 108 are equally spaced apart from one another around the respective end surfaces of the blades 106, 108. Further, in each of the blades 106, 108, the circumferential locations of each of the notches 114 in the first end of the blade 106 or 108 are angularly offset from the circumferential locations of each of the notches 116 in the second end of the blade 106 or 108. Specifically, each of the notches 114 in the first end of a blade 106 or 108 is equally spaced angularly apart from two of the notches 116 in the second end of the blade 106 or 108, and each of the notches 116 in the second end of a blade 106 or 108 is equally spaced angularly apart from two of the notches 114 in the first end of the blade 106 or 108.

Each of the notches 114 and 116 terminates at the outer circumferential surface of the respective blade 106 or 108, such that the notches 114 and 116 form a plurality of crescent-shaped or semi-circular indentations in the blades 106 and 108 when viewed in a direction perpendicular to the central longitudinal axes of the rotors 102, 104 and of the blades 106, 108, as illustrated in FIG. 1. The blades 106 are arranged such that each of the blades 106 has its notches 114 and 116 located at the same circumferential or angular positions as each of the other blades 106. Similarly, the blades 108 are arranged such that each of the blades 108 has its notches 114 and 116 located at the same circumferential or angular positions as each of the other blades 108.

In operation, the rotor 102 and the blades 106 mounted thereon rotate about a central longitudinal axis of the rotor 102 in a first direction and the rotor 104 and the blades 108 mounted thereon rotate about a central longitudinal axis of the rotor 104 in a second direction opposite to the first direction. The blades 106, 108, and the notches 114, 116 thereof are arranged so that when one of the notches 114 of each of the blades 106 reach a position closest to the rotor 104, a corresponding one of the notches 116 of each of the blades 108 reach a position closest to the rotor 102, and so that when one of the notches 116 of each of the blades 106 reach a position closest to the rotor 104, a corresponding one of the notches 114 of each of the blades 108 reach a position closest to the rotor 102. Similarly, when one of the notches 116 of each of the blades 108 reach a position closest to the rotor 102, a corresponding one of the notches 114 of each of the blades 106 reach a position closest to the rotor 104, and when one of the notches 114 of each of the blades 108 reach a position closest to the rotor 102, a corresponding one of the notches 116 of each of the blades 106 reach a position closest to the rotor 104.

Figure 2:
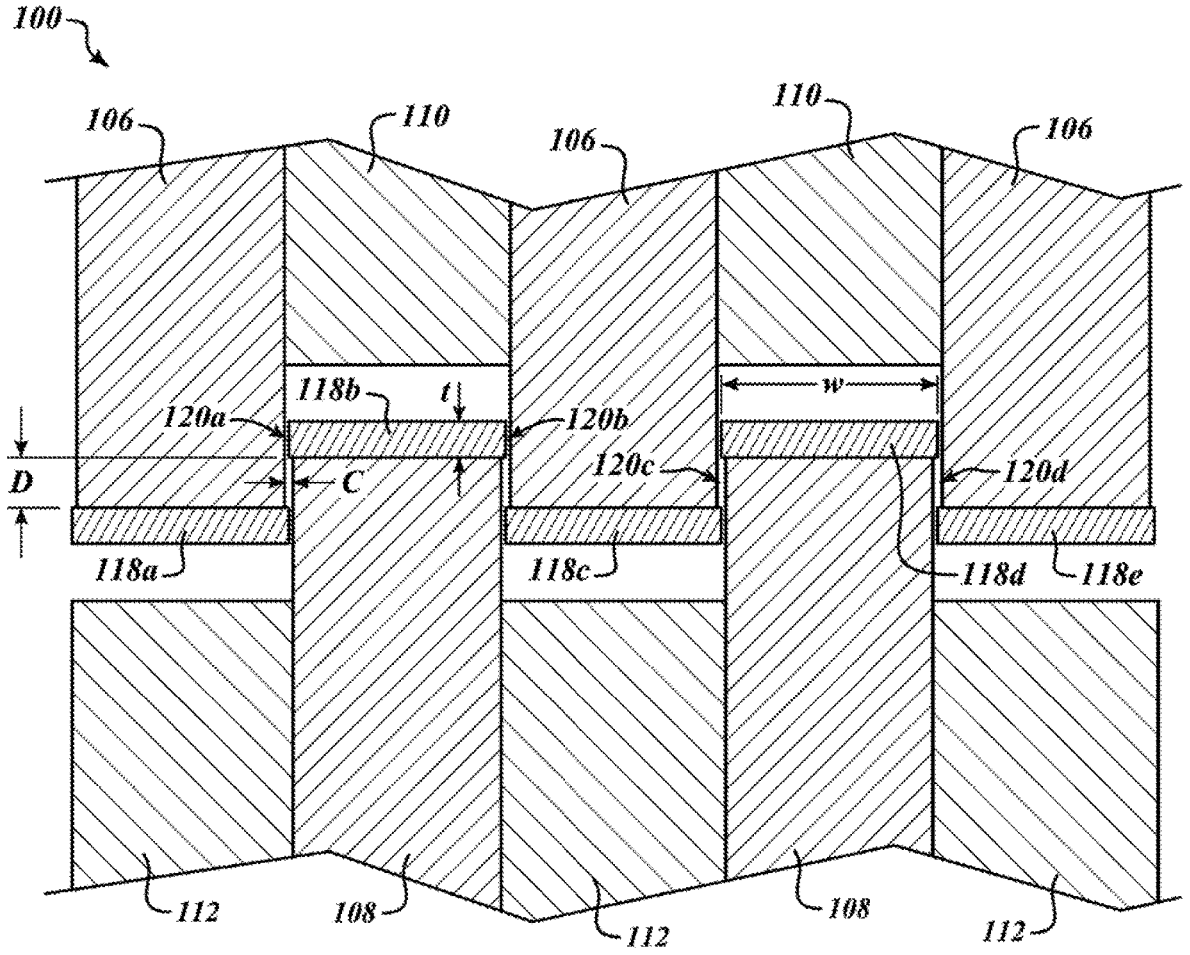
FIG. 2 illustrates a cross-sectional view of the rotary slitting blades of FIG. 1 slitting a piece of sheet metal, according to at least one illustrated implementation.

FIG. 2 illustrates the rotary slitting system 100 being used to create a plurality of slits in a piece of sheet metal 118 by shearing the piece of sheet metal 118 at various locations. As illustrated in FIG. 2, the rotary slitting system 100 receives a continuous piece of sheet metal 118 as input, and slices the piece of sheet metal 118 to form a plurality of individual sheet metal strands 118*a*, 118*b*, 118*c*, 118*d*, and 118*e*, having widths indicated as 'W' FIG. 2, separated from one another by a corresponding plurality of slits 120*a*, 120*b*, 120*c*, and 120*d*. The blades 106 and 108 of the rotary slitting system 100 are arranged so that a dimension of a depth of penetration of the blades 106 and 108, indicated as 'D' in FIG. 2, is between 20% and 50%, or between 25% and 30%, of a thickness of the piece of sheet metal 118, indicated as 't' in FIG. 2. Further, a clearance between adjacent ones of the blades 106 and 108, indicated as 'C' in FIG. 2, is between 5% and 10%, or between 5% and 7%, of the thickness t of the piece of sheet metal 118.

Figure 3:
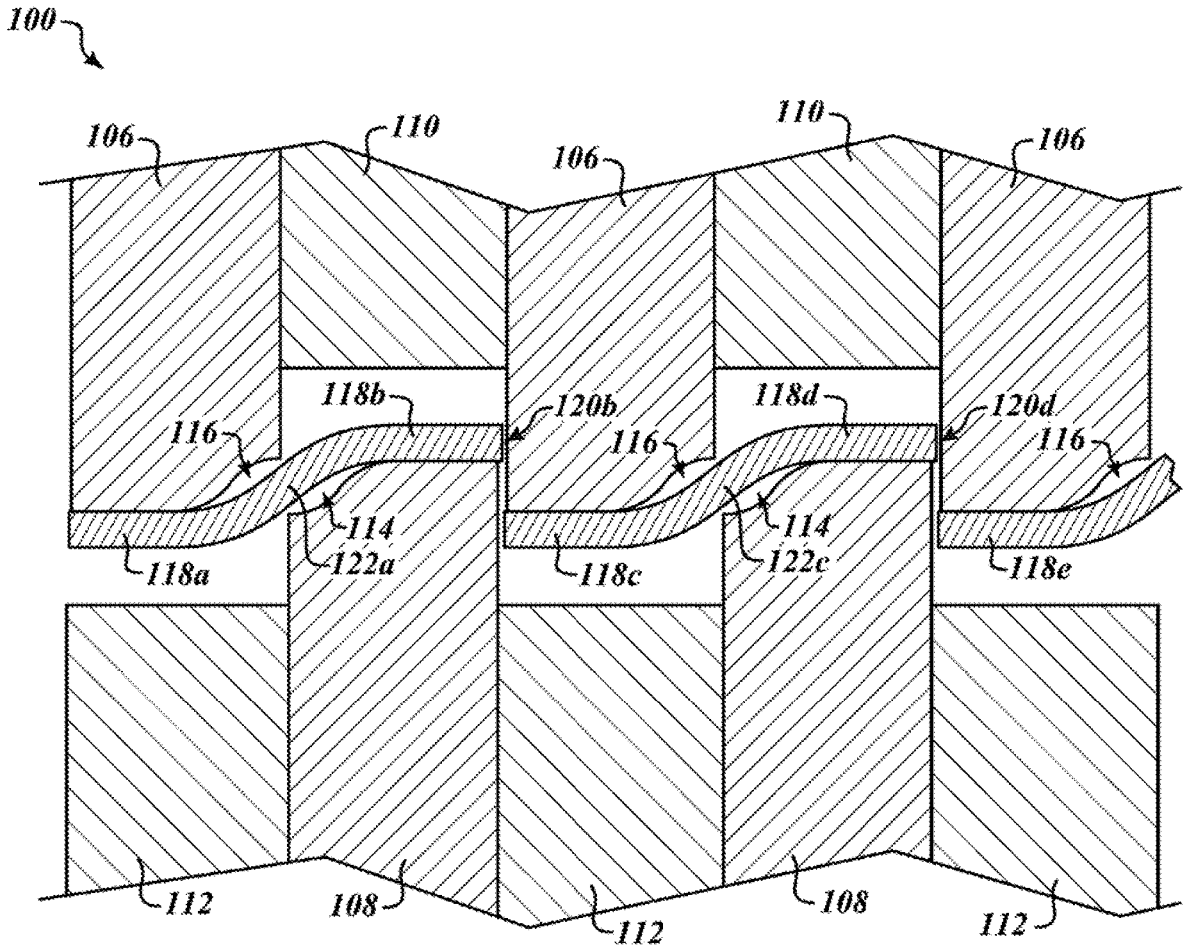
FIG. 3 illustrates a cross-sectional view of the rotary slitting blades of FIG. 1 slitting a piece of sheet metal at a bond section of a resulting expanded metal product, according to at least one illustrated implementation.

FIG. 3 illustrates the rotary slitting system 100 being used to create a plurality of slits, as well as a plurality of bond sections, in the piece of sheet metal 118. Specifically, FIG. 3 illustrates that the blades 106 and 108 have been rotated such that one of the notches 116 of each of the blades 106 is at a position closest to the rotor 104 and a corresponding one of the notches 114 of each of the blades 108 is at a position closest to the rotor 102. In such a configuration, as illustrated in FIG. 3, the rotary slitting system 100 continues to form the slits 120*b* and 120*d*, but interrupts the slits 120*a* and 120*c* to create bond sections 122*a* and 122*c*. Each of the individual sheet metal strands of an expanded metal product, including the plurality of individual sheet metal strands 118*a*, 118*b*, 118*c*, and 118*d*, are monolithically formed with one another because they are created from a single piece of sheet metal. As used herein, the terms "bonded" and "bond section" carry this meaning—two individual sheet metal strands "bonded" to one another at a "bond section" are unitary with one another, or integrally formed from a single piece of material, or monolithically formed with one another.

As the rotors 102, 104 and blades 106, 108 continue to rotate, the alternation of the notches 114 with the notches 116 on the outer surfaces of the blades 106 and 108 alternately interrupt the slits 120*a* and 120*c* to create bond sections 122*a* and 122*c*, and interrupt the slits 120*b* and 120*d* to create bond sections 122*b* and 122*d*. Once the piece of sheet metal 118 has completely passed through the rotary slitting system 100, the piece of sheet metal 118 is fed through a spreading system that pulls the piece of sheet metal 118 in a direction transverse to the slits 120 to pull the adjacent strands 118*a*, 118*b*, 118*c*, 118*d*, and 118*e* apart from one another between their bond sections 122.

Figure 4:
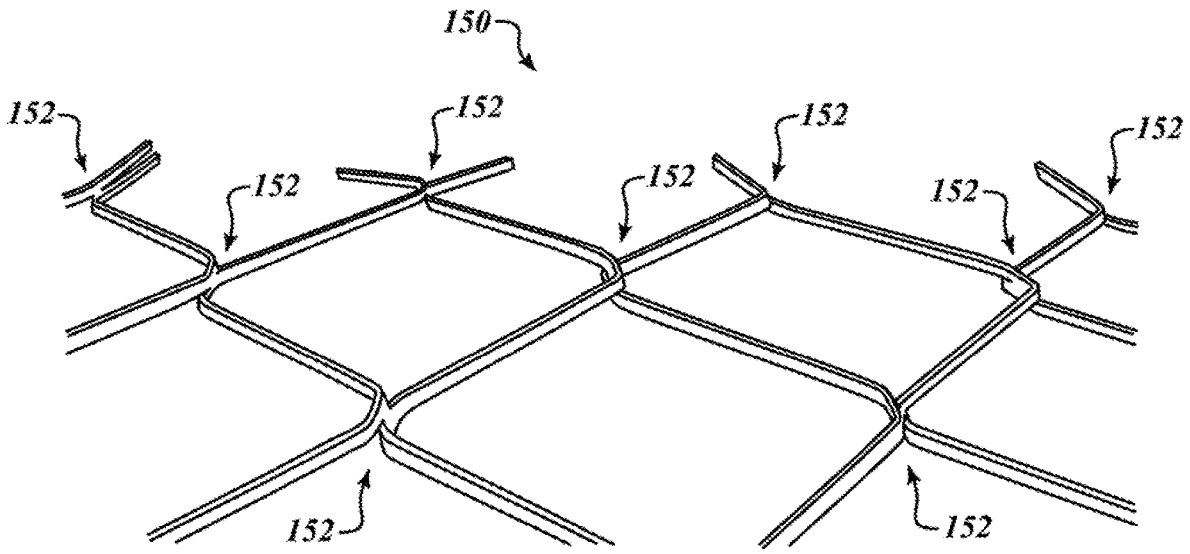
FIG. 4 illustrates a perspective view of an expanded metal product formed using rotary slitting blades, according to at least one illustrated implementation.
Figure 5:
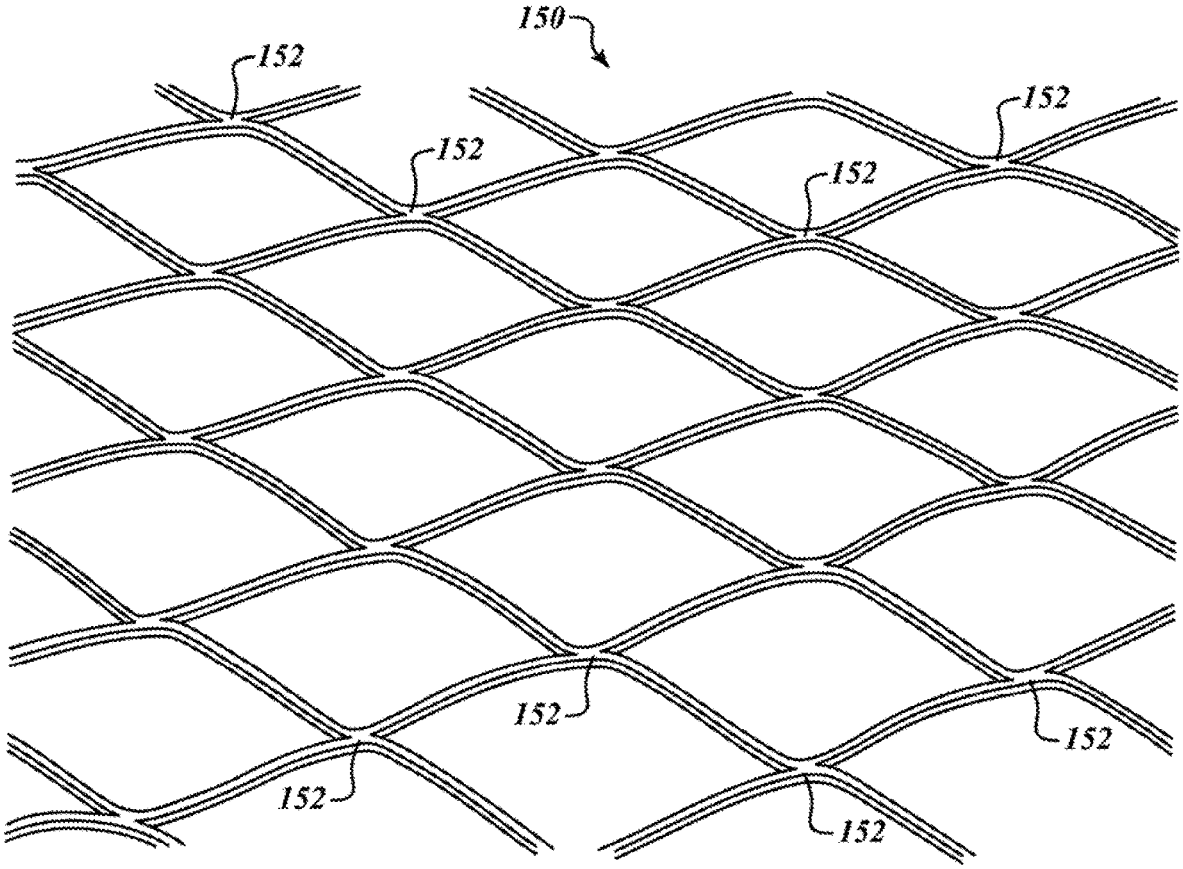
FIG. 5 illustrates a perspective view of the expanded metal product of FIG. 4 after the product undergoes a flattening operation, according to at least one illustrated implementation.

FIG. 4 illustrates an expanded metal product 150 formed using the rotary slitting system 100. As illustrated in FIG. 4, the expanded metal product 150 includes a plurality of bond sections 152 that are rotated and oriented out of plane with respect to the rest of the expanded metal product 150. Thus, once the piece of sheet metal 118 has completely passed through the spreading system, the piece of sheet metal 118 is fed through a flattening system to rotate the bond sections 152 back into the overall plane of the rest of the expanded metal product 150 and render the expanded metal product 150, including its bond sections 152, planar. As used herein, the term "planar" can mean perfectly planar or planar with bond sections 152 deviating from perfectly planar by up to 1°, 2°, 3°, 4°, or 5°. FIG. 5 illustrates the expanded metal product 150 after passing through such a flattening system.

If the rotary slitting system 100 is not configured according to the present disclosure, such processes can create relatively weak transition zones where the slits 120 meet the bond sections 122. In particular, the specific contours of the notches 114 and 116, if not configured as described herein, can lead to the ends of the slits 120 adjacent to the bond sections 122 being improperly or inadequately sheared, creating micro-cracks, stress risers, or other weaknesses. For example, the clearances between the blades 106, 108, including clearance C, affect the quality of the resulting shearing action of the blades 106, 108, with larger than desired clearances resulting in tearing of the piece of sheet metal 118 rather than proper shearing of the piece of sheet metal 118.

Such weaknesses can be compounded or exacerbated by any misalignment of the blades 106 with the blades 108, which can result, as examples, from errors or even accepted tolerances in the installation of the blades 106 and 108 as well as in the timing of the rotation of the blades 106 and 108. Such weaknesses can also become magnified and enlarged by the spreading and flattening processes, thereby creating larger cracks or tears. Additionally, in some rotary slitting systems, the rotary slitting blades include a series of features (often protrusions) that push adjacent strands apart from one another between the bond sections to create the openings in the expanded metal product. Such applications have been found to further magnify or enlarge weaknesses introduced by a slitting process.

Thus, the specific contours of the outer surfaces of the blades 106, 108, and of the notches 114, 116 formed in the blades 106, 108, is important to the overall strength and expected lifetime of resulting expanded metal products. Accordingly, the present disclosure provides rotary slitting blades 106, 108 having notches with advantageous contours and circumferential outer surfaces without protrusions for expanding the piece of sheet metal. Thus, the present disclosure describes rotary slitting blades 106, 108 that slit a piece of sheet metal that is thereafter fed into an expansion system and a flattening system.

Figure 6A:
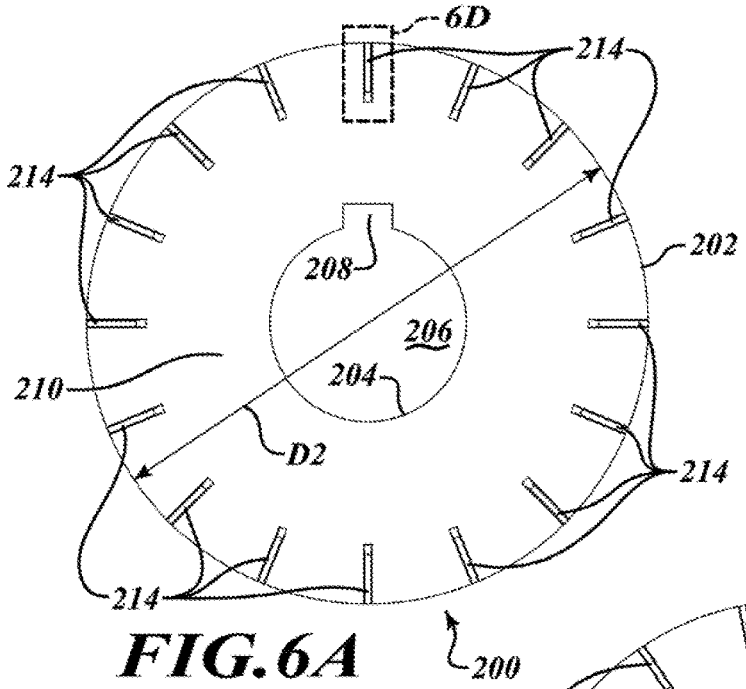
FIG. 6A illustrates a first end view of a rotary slitting blade, according to at least one illustrated implementation.
Figure 6B:
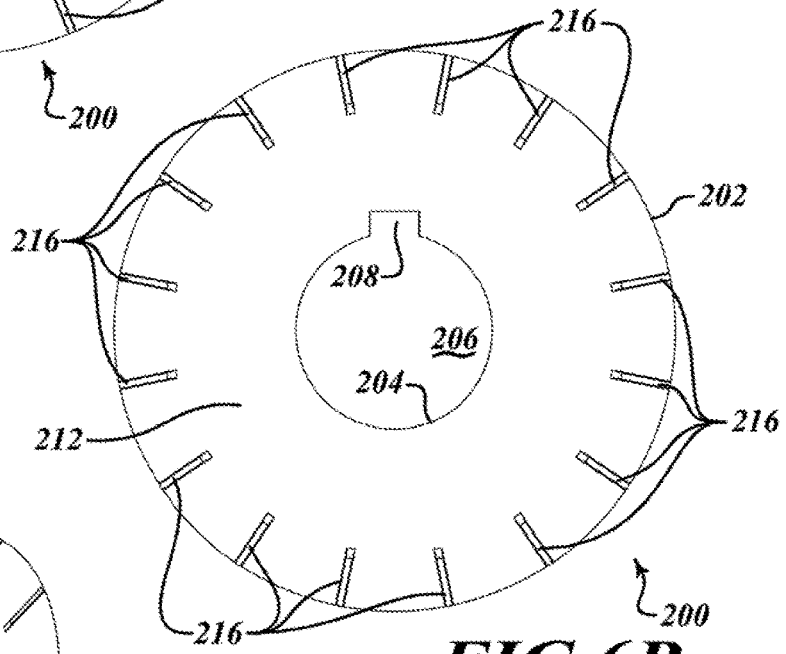
FIG. 6B illustrates a second end view of the rotary slitting blade of FIG. 6A, according to at least one illustrated implementation.
Figure 6C:
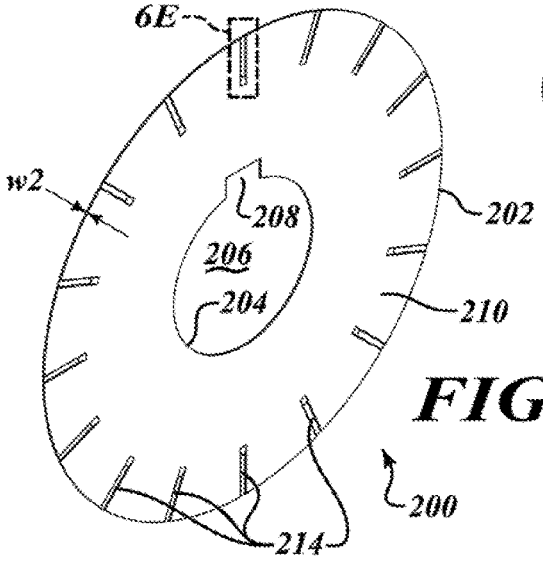
FIG. 6C illustrates a perspective view of the rotary slitting blade of FIGS. 6A and 6B, according to at least one illustrated implementation.

FIGS. 6A-6F illustrate various views of a rotary slitting blade 200. FIGS. 6A-6C illustrate a first end view, a second end view opposite the first, and a perspective view, respectively, of the rotary slitting blade 200. As illustrated in FIGS. 6A-6C, the rotary slitting blade 200 is a very short, hollow cylinder. In particular, the blade 200 has a cylindrical outer surface 202 and a cylindrical inner surface 204 that is concentric with the cylindrical outer surface 202. The inner surface 204 of the blade 200 defines the outer extent of an inner cylindrical open space, void, or opening 206 of the blade 200. The opening 206 includes a groove 208 that extends radially outward from the rest of the cylindrical opening 206 and longitudinally along a thickness or a width of the blade 200 from a first end face or surface 210 thereof to a second end face or surface 212 thereof. The opening 206 is sized to accept a rotor similar to rotor 102 or rotor 104, and the groove 208 is sized to accept a protrusion or a key extending radially outward from the rotor, to rotationally lock the blade 200 to the rotor.

The blade 200 has an overall diameter, indicated as 'D2' in FIG. 6A, greater than 6", 7", 8", or 9", and/or less than 7", 8", 9", or 10". In practice, if the blade 200 is to be used to slit relatively thin pieces of sheet metal, such as those having a thickness t of about 0.015", then the blade 200 has a relatively small outer diameter D2, such as about 6", while if the blade 200 is to be used to slit relatively thick pieces of sheet metal, such as those having a thickness t of about 0.030", then the blade 200 will have a relatively large outer diameter D2, such as about 10". The blade 200 also has an overall thickness or width, indicated as 'W2' in FIG. 6C, greater than 0.030", 0.040", 0.050", 0.060", 0.070", 0.080", or 0.090", and/or less than 0.100", 0.090", 0.080", 0.070", 0.060", 0.050", or 0.040".

FIG. 6A also illustrates that the blade 200 includes a first set of sixteen slots or notches 214 that extend into and along the first end surface 210 thereof, and a second set of sixteen slots or notches 216 that extend into and along the second end surface 212 thereof. The blade 200 and/or the notches 214, 216 can include any of the features described above with respect to the blades 206, 208, and notches 114, 116, respectively. For example, each of the notches 214 and 216 extends into and along and in a radial direction through the respective end surface of the blade 200, to the outer circumferential surface thereof.

Further, the notches 214 are equally spaced apart from one another around the end surface 210 of the blade 200 and the notches 216 are equally spaced apart from one another around the end surface 212 of the blade 200. Additionally, each of the notches 214 in the first end surface 210 is equally spaced angularly apart from two of the notches 216 in the second end surface 212, and each of the notches 216 in the second end surface 212 is equally spaced angularly apart from two of the notches 214 in the first end surface 210.

FIG. 6D illustrates a larger view of a portion of the blade 200 and one of its notches 214, as indicated in FIG. 6A, FIG. 6E illustrates another view thereof, as indicated in FIG. 6C, and FIG. 6F illustrates a larger view thereof, as indicated in FIG. 6E. The notch 214 has an overall length, indicated as in FIG. 6D, extending radially inward from the outer surface 202 of the blade 200 toward the center of the blade 200. The length L of the notch 214 can be greater than or at least as great as a length needed to ensure that an inner end of the notch 214 closest to the center of the blade 200 does not contact a piece of sheet metal as the blade 200 is used to shear the piece of sheet metal to form slits in the piece of sheet metal. In some cases, the length L of the notch 214 can be equal to two times a thickness of the piece of sheet metal (e.g., dimension tin FIG. 2) plus a desired penetration of the blade 200 (e.g., dimension D in FIG. 2).

The notch 214 also has a bottom surface that extends linearly along the length L of the notch 214 and linearly parallel to and along a radial axis of the blade 200. The notch 214 also has a first radial edge 218 and a second radial edge 220 opposite the first radial edge 218, wherein both of the first and second radial edges 218, 220 extend linearly along axes parallel to a central radial axis 224 of the notch 214, inward from the outer surface 202 of the blade 200 toward the center of the blade 200. The notch 214 also has an overall depth, indicated as 'D3' in FIG. 6F, that extends into the end surface 210 of the blade 200. In some cases, the depth D3 is between about 30% and about 50%, or between about ⅓ and about ½ of the blade width W2.

As illustrated in FIG. 6F, a transition between the notch 214 and the first end surface 210 of the blade 200 at the second radial edge 220 is made smooth by a curved portion 222 of the notch 214. As illustrated in FIG. 6F, the curved portion 222 of the notch 214 has a convex curvature that smoothly transitions into the first end surface 210 and that smoothly transitions into the rest of the notch 214, thereby providing a transition from the surface 210 into the notch 214 that has no sharp edges, and such that the surface 210 is blended into the notch 214. In some implementations, the curved portion 222 has a radius of curvature, indicated as 'r1' in FIG. 6F, such that the curved portion 222 extends along a circular profile about an axis that extends parallel to the central radial axis 224 of the notch 214.

The radius of curvature r1 can be greater than 0.004", 0.005", 0.006", 0.007", 0.008", or 0.009", and/or less than 0.005", 0.006", 0.007", 0.008", 0.009", or 0.010". The curved portion 222 has a circular curvature, although in other implementations the curved portion 222 can have a parabolic, elliptical, or other curved profile. Further, r1 is constant along the entire curvature of the curved portion 222, although in other implementations, r1 can be variable along the curvature of the curved portion 222.

As illustrated in FIG. 6F, a transition between the notch 214 and the first end surface 210 of the blade 200 at the first radial edge 218 is made smooth by another curved portion of the notch 214, having features similar to or the same as the curved portion 222 of the notch 214. Similarly, each of the sixteen notches 214 of the blade 200 illustrated in FIGS. 6A and 6C have the same features, including two radial edges and respective curved portions, as illustrated for the notch 214 in FIGS. 6D-6F. Similarly, each of the sixteen notches 216 of the blade 200 illustrated in FIG. 6B have the same features, including two radial edges and respective curved portions, as illustrated for the notch 214 in FIGS. 6D-6F.

It has been found that providing rotary slitting blades with notches having curved transition portions, as illustrated in FIGS. 6A-6F, improves the transition between slits and bond sections in resulting expanded metal products by reducing or even eliminating necking of the bond section during expansion and flattening operations, and reducing or even eliminating fracturing or other damage resulting from fractures, such as splitting, cracking, rupturing, breakage, and/or tearing at the transition between slits and bond sections in resulting expanded metal products. For example, providing rotary slitting blades with notches having curved transition portions, as illustrated in FIGS. 6A-6F, can allow the fabrication of an expanded metal product with fewer than 70%, fewer than 65%, fewer than 60%, fewer than 55%, fewer than 50%, fewer than 45%, fewer than 40%, fewer than 35%, fewer than 30%, fewer than 25%, fewer than 20%, fewer than 15%, fewer than 10%, or fewer than 5% of its bond sections having fractures that are optically detectable or visible, such as by the unaided eye or under a microscope. It is expected that fabrication of an expanded metal product with fewer than 25% of its bond sections having optically detectable or visible fractures in particular would provide important practical, industrial, and commercial advantages.

It has also been found that providing a rotary slitting blade 200 with notches having curved transition portions, as illustrated in FIGS. 6A-6F, provides further advantages in that, when the outer surface 202 of the blade 200 is ground down to sharpen the blade, the entirety of the curved transition portions remains as it was prior to the grinding, reducing the need for further maintenance. It has further been found that the rotary slitting blade 200 is particularly advantageous for use in slitting relatively thin pieces of sheet metal, such as pieces of sheet metal having a thickness less than or equal to 0.015", or for use in slitting pieces of sheet metal when a desired penetration is relatively small, such as less than or equal to about 25% of a thickness of the piece of sheet metal to be processed.

FIG. 7A illustrates a portion of another blade 300 and one of its notches 314, and FIGS. 7B and 7C illustrate perspective views thereof. Except as otherwise described herein the blade 300 and its notch 314 have features that are the same as or similar to the features described herein for blade 200 and its notch 214, respectively. The notch 314 has a first radial edge 318 and a second radial edge 320 opposite the first radial edge 318, wherein both of the first and second radial edges 318, 320 extend along axes parallel to a central radial axis 324 of the notch 314, inward from the outer surface 302 of the blade 300 toward the center of the blade 300.

As illustrated in FIG. 7C, a transition between the notch 314 and the outer surface 302 of the blade 300, at a location where the second radial edge 320 meets the outer surface 302, is made smooth by a curved portion 322 of the notch 314. As illustrated in FIG. 7C, the curved portion 322 of the notch 314 has a convex curvature that smoothly transitions into the outer surface 302 and that smoothly transitions into the rest of the notch 314, thereby providing a transition from the surface 302 into the notch 314 that has no sharp edges, and such that the surface 302 is blended into the notch 314. In some implementations, the curved portion 322 has a first radius of curvature at a first location adjacent to the outer surface 302, indicated as 'cr2' in FIG. 7C, and a second radius of curvature at a second location opposite the first location, indicated as 'cr3' in FIG. 7C, such that the curved portion 322 extends along one or more circular profiles about an axis or axes that extend normal to a first end face or surface 310 of the blade 300 and perpendicular to the central radial axis 324 of the notch 314.

In some cases, a curvature of the curved portion 322 is constant along the entire curvature of the curved portion 322, such that the first radius of curvature r2 is the same as the second radius of curvature r3. In such implementations, the constant radius of curvature can be greater than 0.005", 0.006", 0.007", 0.008", 0.009", 0.010", 0.011", 0.012", 0.013", 0.014", 0.015", 0.016", 0.017", 0.018", or 0.019", and/or less than 0.006", 0.007", 0.008", 0.009", 0.010", 0.011", 0.012", 0.013", 0.014", 0.015", 0.016", 0.017", 0.018", 0.019", or 0.020".

In other implementations, the curvature of the curved portion 322 is variable along the entire curvature of the curved portion 322, such that the first radius of curvature r2 is different than the second radius of curvature r3. For example, the radius of curvature of the curved portion 322 can decrease or taper as it extends from bottom of the notch 314 outward toward the end surface 310 of the blade 300, such as from a radius of curvature of about 0.020" at the bottom of the notch 314, linearly or non-linearly with respect to a location's depth within the notch 314, to about 0.005" at the end surface 310 of the blade 300. The curved portion 322 has circular curvature(s), although in other implementations the curved portion 322 can have parabolic, elliptical, or other curved profile(s).

As illustrated in FIG. 7C, a transition between the notch 314 and the outer surface 302 of the blade 300 at the first radial edge 318 is made smooth by another curved portion of the notch 314, having features similar to or the same as the curved portion 322 of the notch 314. Similarly, each of the notches of the blade 300 have the same features, including respective curved portions, as illustrated for the notch 314 in FIGS. 7A-7C.

It has been found that providing rotary slitting blades with notches having curved transition portions, as illustrated in FIGS. 7A-7C, improves the transition between slits and bond sections in resulting expanded metal products by reducing or even eliminating necking of the bond section during expansion and flattening operations, and reducing or even eliminating fracturing or other damage resulting from fractures, such as splitting, cracking, rupturing, breakage, and/or tearing at the transition between slits and bond sections in resulting expanded metal products. For example, providing rotary slitting blades with notches having curved transition portions, as illustrated in FIGS. 7A-7C, can allow the fabrication of an expanded metal product with fewer than 70%, fewer than 65%, fewer than 60%, fewer than 55%, fewer than 50%, fewer than 45%, fewer than 40%, fewer than 35%, fewer than 30%, fewer than 25%, fewer than 20%, fewer than 15%, fewer than 10%, or fewer than 5% of its bond sections having fractures that are optically detectable or visible, such as by the unaided eye or under a microscope. It is expected that fabrication of an expanded metal product with fewer than 25% of its bond sections having optically detectable or visible fractures in particular would provide important practical, industrial, and commercial advantages.

To sharpen the outer surface 302 of a rotary slitting blade 300 with notches having curved transition portions, as illustrated in FIGS. 7A-7C, the outer surface 302 is ground down to sharpen the blade and then the blade 300 is further ground to re-create the curved transition portions. It has been found that the rotary slitting blade 300 is particularly advantageous for use in slitting pieces of sheet metal having a thickness between about 0.016" and about 0.024", or for use in slitting pieces of sheet metal when a desired penetration is between about 50% and 60% of a thickness of the piece of sheet metal to be processed.

FIG. 8A illustrates a portion of another blade 400 and one of its notches 414, and FIGS. 8B and 8C illustrate perspective views thereof. Except as otherwise described herein the blade 400 and its notch 414 have features that are the same as or similar to the features described herein for blade 300 and its notch 314, respectively. The notch 414 has a first radial edge 418 and a second radial edge 420 opposite the first radial edge 418, wherein both of the first and second radial edges 418, 420 extend along axes parallel to a central radial axis 424 of the notch 414, inward from the outer surface 402 of the blade 400 toward the center of the blade 400.

As illustrated in FIG. 8C, a transition between the notch 414 and the outer surface 402 of the blade 400, at a location where the second radial edge 420 meets the outer surface 402, is made smooth by a curved portion 422 of the notch 414. As illustrated in FIG. 8C, the curved portion 422 of the notch 414 has a convex curvature that smoothly transitions into the outer surface 402 and that smoothly transitions into the rest of the notch 414, thereby providing a transition from the surface 402 into the notch 414 that has no sharp edges, and such that the surface 402 is blended into the notch 414.

In some implementations, the curved portion 422 has a first radius of curvature at a first location adjacent to the outer surface 402, indicated as 'cr4' in FIG. 8C, such that the curved portion 422 extends along a circular profile about an axis that extends normal to a first end face or surface 410 of the blade 400 and perpendicular to the central radial axis 424 of the notch 414 at the first end surface 410 of the blade 400. In some implementations, the curved portion 422 also has a second radius of curvature at a second location opposite the first location, indicated as 'cr5' in FIG. 8C, such that the curved portion 422 extends along another circular profile about an axis parallel to a line tangent to a nearest portion of the outer surface 402 and perpendicular to the central radial axis 424 of the notch 414 at the bottom of the notch 414.

The curved portion 422 thus includes two distinct forms of curvature. First, the curved portion has a convex curvature that curves with the first radius of curvature r4 and the second radius of curvature r5 from the outer surface 402 to the notch 414. In some implementations, this first curvature is constant along the entire curvature of the curved portion 422, such that the first radius of curvature r4 is the same as the second radius of curvature r5. In other implementations, this first curvature is variable along the entire curvature of the curved portion 422, such that the first radius of curvature r4 is different than the second radius of curvature r5. For example, the radius of curvature of the curved portion 422 can increase as it extends from bottom of the notch 414 outward toward the end surface 410 of the blade 400, such as from a radius of curvature of about 0.000" at the bottom of the notch 414, linearly or non-linearly with respect to a location's depth within the notch 414, to about 0.010" at the end surface 410 of the blade 400. The curved portion 422 has circular curvature(s), although in other implementations the curved portion 422 can have parabolic, elliptical, or other curved profile(s).

Second, the curved portion 422 has a concave curvature that curves from the location of the first radius of curvature r4 at the end surface 410 of the blade 400 to the location of the second radius of curvature r5 at the bottom of the notch 414. Thus the curved portion 422 has a third radius of curvature, indicated as 'cr6' in FIG. 8C, such that the curved portion 422 extends along a circular profile about an axis that extends parallel to the central radial axis 424 of the notch 414 as it extends from the first end surface 410 to the bottom of the notch 414. This dual curvature of the curved portion 422 gives the curved portion 422 a shape resembling a portion of a torus.

As illustrated in FIG. 8C, a transition between the notch 414 and the outer surface 402 of the blade 400 at the first radial edge 418 is made smooth by another curved portion of the notch 414, having features similar to or the same as the curved portion 422 of the notch 414. Similarly, each of the notches of the blade 400 have the same features, including respective curved portions, as illustrated for the notch 414 in FIGS. 8A-8C.

Applicant has found that providing rotary slitting blades with notches having curved transition portions, as illustrated in FIGS. 8A-8C, improves the transition between slits and bond sections in resulting expanded metal products by reducing or even eliminating necking of the bond section during expansion and flattening operations, and reducing or even eliminating fracturing or other damage resulting from fractures, such as splitting, cracking, rupturing, breakage, and/or tearing at the transition between slits and bond sections in resulting expanded metal products. For example, providing rotary slitting blades with notches having curved transition portions, as illustrated in FIGS. 8A-8C, can allow the fabrication of an expanded metal product with fewer than 70%, fewer than 65%, fewer than 60%, fewer than 55%, fewer than 50%, fewer than 45%, fewer than 40%, fewer than 35%, fewer than 30%, fewer than 25%, fewer than 20%, fewer than 15%, fewer than 10%, or fewer than 5% of its bond sections having fractures that are optically detectable or visible, such as by the unaided eye or under a microscope. It is expected that fabrication of an expanded metal product with fewer than 25% of its bond sections having optically detectable or visible fractures in particular would provide important practical, industrial, and commercial advantages.

To sharpen the outer surface 402 of a rotary slitting blade 400 with notches having curved transition portions, as illustrated in FIGS. 8A-8C, the outer surface 402 is ground down to sharpen the blade and then the blade 400 is further ground to re-create the curved transition portions. It has been found that the rotary slitting blade 400 is particularly advantageous for use in slitting pieces of sheet metal having a thickness between about 0.016" and about 0.020", or for use in slitting pieces of sheet metal when a desired penetration is between about 30% and 35% of a thickness of the piece of sheet metal to be processed.

FIG. 9A illustrates a portion of another blade 500 and one of its notches 514, and FIGS. 9B and 9C illustrate perspective views thereof. The blade 500 and its notch 514 have features that are a combination of the features described herein for the blades 200 and 300 and notches 214 and 314, respectively. The notch 514 has a first radial edge 518 and a second radial edge 520 opposite the first radial edge 518, wherein both of the first and second radial edges 518, 520 extend along axes parallel to a central radial axis 526 of the notch 514, inward from the outer surface 502 of the blade 500 toward the center of the blade 500.

As illustrated in FIG. 9C, a transition between the notch 514 and the first end face or surface 510 of the blade 500 at the second radial edge 520 is made smooth by a curved portion 522 of the notch 514, which is the same as or similar to the curved portion 222 of the notch 214. As also illustrated in FIG. 9C, a transition between the notch 514 and the outer surface 502 of the blade 500, at a location where the second radial edge 520 meets the outer surface 502, is made smooth by a curved portion 524 of the notch 514, which is the same as or similar to the curved portion 322 of the notch 314.

As illustrated in FIG. 9C, a transition between the notch 514 and the outer surface 502 of the blade 500 at the first radial edge 518 is made smooth by another curved portion of the notch 514, having features similar to or the same as the curved portion 524 of the notch 514. As also illustrated in FIG. 9C, a transition between the notch 514 and the first end surface 510 of the blade 500 at the first radial edge 518 is made smooth by another curved portion of the notch 514, having features similar to or the same as the curved portion 522 of the notch 514. Similarly, each of the notches of the blade 500 have the same features, including respective curved portions, as illustrated for the notch 514 in FIGS. 9A-9C.

Applicant has found that providing rotary slitting blades with notches having curved transition portions, as illustrated in FIGS. 9A-9C, improves the transition between slits and bond sections in resulting expanded metal products by reducing or even eliminating necking of the bond section during expansion and flattening operations, and reducing or even eliminating fracturing or other damage resulting from fractures, such as splitting, cracking, rupturing, breakage, and/or tearing at the transition between slits and bond sections in resulting expanded metal products. For example, providing rotary slitting blades with notches having curved transition portions, as illustrated in FIGS. 9A-9C, can allow the fabrication of an expanded metal product with fewer than 70%, fewer than 65%, fewer than 60%, fewer than 55%, fewer than 50%, fewer than 45%, fewer than 40%, fewer than 35%, fewer than 30%, fewer than 25%, fewer than 20%, fewer than 15%, fewer than 10%, or fewer than 5% of its bond sections having fractures that are optically detectable or visible, such as by the unaided eye or under a microscope. It is expected that fabrication of an expanded metal product with fewer than 25% of its bond sections having optically detectable or visible fractures in particular would provide important practical, industrial, and commercial advantages.

To sharpen the outer surface 502 of a rotary slitting blade 500 with notches having curved transition portions, as illustrated in FIGS. 9A-9C, the outer surface 502 is ground down to sharpen the blade and then the blade 500 is further ground to re-create the curved transition portions. It has been found that the rotary slitting blade 500 is particularly advantageous for use in slitting pieces of sheet metal having a thickness between about 0.016" and about 0.032", or for use in slitting pieces of sheet metal when a desired penetration is less than or equal to about 75% of a thickness of the piece of sheet metal to be processed.

While FIGS. 9A-9C illustrate a portion of a blade 500 and one of its notches 514 that combine the features of blades 200 and 300 and notches 214 and 314, respectively, another blade and its notches could in the same manner combine the features of blades 200 and 400 and notches 214 and 414, respectively. In such an implementation, a transition between a notch and a first end surface of the blade at a radial edge of the notch is made smooth by a curved portion of the notch which is the same as or similar to the curved portion 222 of the notch 214, and a transition between the notch and an outer surface of the blade at a location where the radial edge meets the outer surface is made smooth by a curved portion of the notch which is the same as or similar to the curved portion 322 of the notch 314.

The various implementations described above can be combined to provide further implementations. All of the commonly assigned US patent application publications, US patent applications, foreign patents, and foreign patent applications referred to in this specification and/or listed in the Application Data Sheet are incorporated herein by reference, in their entirety, including but not limited to U.S. provisional patent application No. 62/731,613, filed Sep. 14, 2018.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

What is claimed is:

1. A rotary blade, comprising:

a cylindrical body having a first end face, a second end face opposite the first end face, and an outer circumferential surface that extends from the first end face to the second end face;

a first plurality of notches in the first end face that extend radially toward and that intersect the outer circumferential surface, wherein each of the first plurality of notches includes a first edge, a second edge opposite the first edge, and a respective curved surface having a convex curvature that smoothly transitions radially from the outer circumferential surface to the first edge; and a second plurality of notches in the second end face that extend radially toward and that intersect the outer circumferential surface, wherein each of the second plurality of notches includes a third edge, a fourth edge opposite the third edge, and a respective curved surface having a convex curvature that smoothly transitions radially from the outer circumferential surface to the third edge.

2. The rotary blade of claim 1 wherein each of the curved surfaces has a radius of curvature of between 0.004 inches and 0.010 inches.

3. The rotary blade of claim 1 wherein each of the curved surfaces has a radius of curvature that is constant along an entire length of the curved surface.

4. A rotary blade, comprising:

a cylindrical body having a first end face, a second end face opposite the first end face, and an outer circumferential surface that extends from the first end face to the second end face;

a first plurality of notches in the first end face that extend radially toward and that intersect the outer circumferential surface, wherein each of the first plurality of notches includes a respective first plurality of curved surfaces positioned such that a transition from the outer circumferential surface to each of the first plurality of notches is devoid of any sharp edges; and a second plurality of notches in the second end face that extend radially toward and that intersect the outer circumferential surface, wherein each of the second plurality of notches includes a respective second plurality of curved surfaces positioned such that a transition from the outer circumferential surface to each of the second plurality of notches is devoid of any sharp edges.

5. The rotary blade of claim 4 wherein each of the plurality of curved surfaces has a constant curvature along an entire length of the respective curved surface.

6. The rotary blade of claim 5 wherein each of the plurality of curved surfaces has a radius of curvature of between 0.005 inches and 0.020 inches.

7. The rotary blade of claim 4 wherein at least one of the first plurality of curved surfaces of each of the first plurality of notches has a first radius of curvature at a first location adjacent to the outer circumferential surface and a second radius of curvature at a second location opposite the first location, wherein the first radius of curvature is smaller than the second radius of curvature.

8. The rotary blade of claim 7 wherein the first radius of curvature is about 0.005 inches and the second radius of curvature is about 0.020 inches.

9. The rotary blade of claim 4 wherein at least one of the first plurality of curved surfaces of each of the first plurality of notches has a first radius of curvature at a first location adjacent to the outer circumferential surface and a second radius of curvature at a second location opposite the first location, wherein the first radius of curvature is larger than the second radius of curvature.

10. The rotary blade of claim 9 wherein the first radius of curvature is about 0.010 inches.

11. The rotary blade of claim 4 wherein at least one of the first plurality of curved surfaces of each of the first plurality of notches has both a convex curvature and a concave curvature.

12. A rotary blade, comprising:

a cylindrical body having a first end face, a second end face opposite the first end face, and an outer circumferential surface that extends from the first end face to the second end face;

a first plurality of notches in the first end face that extend radially toward and that intersect the outer circumferential surface, wherein each of the first plurality of notches includes a respective curved surface having a convex curvature that smoothly transitions into the outer circumferential surface; and a second plurality of notches in the second end face that extend radially toward and that intersect the outer circumferential surface, wherein each of the second plurality of notches includes a respective curved surface having a convex curvature that smoothly transitions into the outer circumferential surface, wherein each of the curved surfaces has a first radius of curvature at a first location adjacent to the outer circumferential surface and a second radius of curvature at a second location opposite the first location, wherein the first radius of curvature is smaller than the second radius of curvature.

13. The rotary blade of claim 12 wherein each of the curved surfaces has both a convex curvature and a concave curvature.

14. A rotary blade, comprising:

a cylindrical body having a first end face, a second end face opposite the first end face, and an outer circumferential surface that extends from the first end face to the second end face;

a first plurality of notches in the first end face that extend radially toward and that intersect the outer circumferential surface, wherein each of the first plurality of notches includes a respective curved surface having a convex curvature that smoothly transitions into the outer circumferential surface; and a second plurality of notches in the second end face that extend radially toward and that intersect the outer circumferential surface, wherein each of the second plurality of notches includes a respective curved surface having a convex curvature that smoothly transitions into the outer circumferential surface, wherein each of the curved surfaces has a first radius of curvature at a first location adjacent to the outer circumferential surface and a second radius of curvature at a second location opposite the first location, wherein the first radius of curvature is larger than the second radius of curvature.

15. The rotary blade of claim 14 wherein each of the curved surfaces has both a convex curvature and a concave curvature.

* * * * *